US007127191B2

(12) United States Patent
Mori et al.

(10) Patent No.: US 7,127,191 B2
(45) Date of Patent: Oct. 24, 2006

(54) CLEANING DEVICE FOR COLLECTING TONER ON A SURFACE OF AN IMAGE FORMING APPARATUS

(75) Inventors: Tomohide Mori, Tokyo (JP); Hidetoshi Noguchi, Tokyo (JP); Hideo Yamaki, Tokyo (JP); Yasunori Nakayama, Tokyo (JP); Yasuo Tanaka, Hino (JP); Satoru Shibuya, Tokyo (JP); Hideji Higashimura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 47 days.

(21) Appl. No.: 10/809,786

(22) Filed: Mar. 26, 2004

(65) Prior Publication Data

US 2004/0213598 A1 Oct. 28, 2004

(30) Foreign Application Priority Data

| | | |
|---|---|---|
| Mar. 26, 2003 | (JP) | 2003-085261 |
| Feb. 27, 2004 | (JP) | 2004-053834 |
| Feb. 27, 2004 | (JP) | 2004-054334 |

(51) Int. Cl.
*G03G 15/16* (2006.01)

(52) U.S. Cl. ..... 399/101

(58) Field of Classification Search ..... 399/101, 399/302, 343, 349, 353, 354, 357
See application file for complete search history.

(56) References Cited

U.S. PATENT DOCUMENTS

| | | | | |
|---|---|---|---|---|
| 5,481,351 | A * | 1/1996 | Kawai et al. | 399/359 |
| 5,768,653 | A * | 6/1998 | Fare | 399/50 |
| 6,014,540 | A * | 1/2000 | Sako et al. | 399/343 |
| 6,097,924 | A * | 8/2000 | Okuyama | 399/315 |
| 6,605,399 | B1 * | 8/2003 | Chowdry et al. | 430/62 |
| 6,654,574 | B1 * | 11/2003 | Kayahara et al. | 399/101 |
| 6,768,892 | B1 * | 7/2004 | Sawai | 399/302 |

FOREIGN PATENT DOCUMENTS

| | | |
|---|---|---|
| JP | 4-112274 | 9/1992 |
| JP | 8-50437 | 2/1996 |
| JP | 2954812 | 7/1999 |

* cited by examiner

*Primary Examiner*—Diego Gutierrez
*Assistant Examiner*—Dixomara Vargas
(74) *Attorney, Agent, or Firm*—Morrison & Foerster LLP

(57) ABSTRACT

A cleaning device is provided with a conductive fur brush kept in contact with a transfer belt, a conductive brush kept in contact with the transfer belt upstream of the fur brush in the feed direction, and a single of constant-current d.c. power supply. The fur brush is connected to the constant-current d.c. power supply, and the conductive brush is grounded. A current flows from the constant-current d.c. power supply via the transfer belt to the conductive brush.

8 Claims, 30 Drawing Sheets

CLEANING DEVICE FOR COLLECTING TONER ON A SURFACE OF AN IMAGE FORMING APPARATUS

RELATED APPLICATION

This application is based on applications Nos. 2003-85261, 2004-53834 and 2004-54334 filed in Japan, the contents to which is hereby incorporated by reference

BACKGROUND OF THE INVENTION

The present invention relates to a cleaning device and an image forming apparatus. More specifically, the present invention is preferably applied to cleaning devices provided in image forming apparatuses such as laser printers, copying machines, facsimile devices and multi-function machines of these apparatuses.

An image forming apparatus is provided with a cleaning device for collecting toner remaining on the surface of a photoconductor (e.g., photoconductor drum or photoconductor belt) or an intermediate transfer member (e.g., intermediate transfer belt or intermediate transfer drum) as image bearing bodies after transfer of a toner image. The toner remaining on the surface of the image bearing bodies after transfer is partially charged to a reverse polarity, thus being nonuniform in electric charge distribution. In order to effectively collect such residual toner, various cleaning devices have been proposed .

With reference to FIG. 29, a cleaning device disclosed in Japanese utility model application laid-open publication No. H04-112274 is provided with a pair of fur brushes 2A and 2B disposed so as to be contact with the surface of a photoconductor 1. Bias voltages with polarities opposite to each other are applied to each of the fur brushes 2A, 2B by individual power supplies 3A, 3B. The residual toner with a normal charge polarity (negative polarity) is collected by the fur brush 2A to which a positive-polarity voltage is applied by the power supply source 3A. The residual toner with a reverse polarity (positive polarity) is collected by the fur brush 2B to which a negative-polarity voltage is applied by the power supply 3B.

With reference to FIG. 30, a cleaning device disclosed in Japanese patent application laid-open publication No. H08-50437 is provided with one fur brush 5 disposed so as to be contact with the surface of a photoconductor 4. Bias voltage with a polarity (negative polarity) reverse to a normal charge polarity (positive polarity) of the residual toner is applied to the fur brush 5 via a collection roller 6 having conductivity by a power supply 7A. Upstream from the fur brush 5 in the rotating direction of the photoconductor 4, disposed is a charger 8 connected to a power supply 7B. Before being collected by the fur brush 5, the residual toner is charged or discharged by the charger 8, and their charge polarity is unified. A similar cleaning device is also disclosed in Japanese Patent No. 2954812.

However, the conventional cleaning device requires a plurality of power supplies. For details, in the case of the cleaning device in FIG. 29, two fur brushes 2A, 2B each require one power supply and so the total two power supplies 3A, 3B are necessary. Similarly, in the cleaning device in FIG. 30, the fur brush 5 and the charger 8 each require one power supply and so the total two power supplies 7A, 7B are necessary. This increases size of the cleaning device and costs.

A charge amount of toner remaining on the surface of the image bearing body varies depending on various conditions such as a current flowing to a transfer portion. As in the case of the cleaning device in FIG. 30, if the charger 8 for the discharging purpose is provided before the fur brush 5 as a cleaning member, the charge polarity and the charge amount of the toner having reached the fur brush 5 can be unified. However, since two power supplies are necessary as described before, the cleaning device grows in size. In the case of the cleaning device without a mechanism for discharge such as the charger 8, a voltage to be applied to the cleaning member needs to be set high for securely collecting toner particles different in charge polarity and charge amount. However, this imposes the following problems. First, an excessive cleaning current flowing to an image bearing body charges the image bearing body and this would cause image failures. Moreover, the excessive cleaning current causes the image bearing body to have a shorter life. Further, if the charge amount of the toner is small, the toner is charged with a polarity reverse to a normal charge polarity due to the excessive cleaning current, which degrades a cleaning capability. Similarly, the amount of the toner remaining on the surface of the image bearing body varies depending on various conditions.

A primary transfer device in an image forming apparatus of intermediate transfer method, which is generally provided with a constant-voltage power supply, transfers a toner image on a photoconductor to an intermediate transfer member by applying a constant voltage with a polarity reverse to a normal charge polarity of the toner image. Accordingly, if a resistance of the intermediate transfer member is decreased by duration, or if a humidity inside the image forming apparatus is high, an excessive current generated in a primary transfer device could flow into the cleaning device via the intermediate transfer member. The excessive current generated in the primary transfer device damages the intermediate transfer member and causes the intermediate transfer member to have a shorter life.

SUMMARY OF THE INVENTION

An object of the present invention is to provide a small-size and low-cost cleaning device capable of effectively removing residual toner on the surfaces of image bearing bodies. Another object of the present invention is to enable the cleaning device to maintain an appropriate cleaning capability even if the charge amount of residual toner or the amount of the residual toner has changed. Still another object of the present invention to prevent an excessive current from flowing from a primary transfer device to an intermediate transfer member.

In a first aspect of the present invention, there is provided a cleaning device for collecting toner on a surface of an image bearing body. According to this aspect of the invention, a rotary member has electrical conductivity and may be rotatively driven while being in contact with the surface of the image bearing body. Also included may be a conductive member which makes contact with the image bearing body on an upstream side of the rotary member in a feed direction of the image bearing body. A d.c. power supply can be connected to either the rotary member or the conductive member, where the one not connected to the d.c. power supply is grounded. Such an arrangement generates a d.c. current that flows via the image bearing body between the rotary member and the conductive member, whereby a first electric field in such a direction as to exert a force for adsorbing the toner of a normal charging polarity to the rotary member is generated between the rotary member and the image bearing body while a second electric field in a direction reverse to the first electric field is generated between the conductive member and the image bearing body.

In the cleaning device of the first aspect, toner of the normal charging polarity on the image bearing body surface is electrostatically adsorbed to the rotary member, and thereby collected, by the first electric field generated between the rotary member and the image bearing body. Also, since a second electric field reverse in direction to the first electric field is generated between the conductive member and the image bearing body, the conductive member serves as a charge elimination member so that the toner charged to a reversed polarity on the image bearing body surface becomes the normal charging polarity while passing through the conductive member. Thus, toner that has been uniformized in charging polarity to the normal charging polarity reaches the rotary member, allowing the collection of the toner to be efficiently achieved.

One of the rotary member and the conductive member is connected to the d.c. power supply, while the other is grounded, and the one-in-number d.c. power supply only is provided as the power supply for use of charge impartment or electric field generation. Thus, a downsizing of the apparatus and a reduction in cost become achievable. The rotary member may be connected to the d.c. power supply while the conductive member is grounded, alternatively, the conductive member may be connected to the d.c. power supply while the rotary member is grounded.

The image bearing body may be a photoconductor including a photoconductor drum and a photoconductor belt, and may be an intermediate transfer member including an intermediate transfer belt and an intermediate transfer drum.

The d.c. power supply is, for example, a regulated or constant-current d.c. power supply. Using the constant-current d.c. power supply as the power supply for use of electric field generation makes it possible to provide a certain amount of current flow even if the resistance has increased due to adhesion of the toner to the rotary member or the conductive member or due to the endurance changes of the image bearing body or the like. Thus, even with increased resistance, the strength of the electric field generated at the rotary member or the conductive member can be maintained, preventing any deterioration of the collection efficiency.

The d.c. power supply may be connected to the rotary member or the conductive member either indirectly or directly. For example, in the case where the rotary member is a fur brush, the d.c. power supply may be indirectly connected to it via a flicker or via a collection roller and scraper. Also, the d.c. power supply may be connected directly to the rotating shaft of the fur brush.

The rotary member may be one which has electrical conductivity and which rotates in a direction reverse to the conveyance direction of the image bearing body (feed direction in the case of a photoconductor belt or an intermediate transfer belt, the rotational direction in the case of a photoconductor drum or an intermediate transfer drum), and which is capable of at least electrostatically adsorbing and collecting the residual toner on the image bearing body surface. For example, the rotary member is a fur brush, a conductive elastic roller, or a metallic roller.

The conductive member may be one which has electrical conductivity and which makes uniform contact with the image bearing body surface, and which is small in frictional resistance with the surface of the image bearing body. For example, a conductive brush, a conductive film, conductive rubber, or a fur brush may be used as the conductive member.

The current fed from the d.c. power supply flows between the rotary member and the conductive member via the image bearing body. Therefore, when the image bearing body is an intermediate transfer belt stretched on a plurality of stretching rollers, the stretching roller opposite to the rotary member with the intermediate transfer belt interposed therebetween does not need to be grounded. This allows the stretching roller to be electrically floating state. Accordingly, even when the image forming apparatus is downsized so that the cleaning device is placed in proximity to the primary transfer section or the secondary transfer section, inflow of the transfer current from these transfer sections into the cleaning device can be prevented, thus allowing transfer failures due to inflow of the transfer current as well as image failures due to the inflow to be prevented.

Also, when the image bearing body is an intermediate transfer member, it is preferable that the distance between the rotary member and the conductive member is shorter than the distance between the rotary member and the primary transfer section or the secondary transfer section, whichever is closest to the rotary member, in order to further ensure the prevention of the inflow of the transfer current from the primary transfer section or the secondary transfer section. That is, preferably, the conductive member is placed so as to be spaced from the rotary member and the distance in the conveyance direction of the intermediate transfer member from the contact position of the rotary member with the intermediate transfer member to the contact position of the conductive member with the intermediate transfer member is shorter than the distance in the conveyance direction of the intermediate transfer member from the contact position of the rotary member with the intermediate transfer member to the both nip portions between the intermediate transfer member and the primary and secondary transfer sections.

Preferably, the direct current $I_C$ (μA) flows between the rotary member and the conductive member via the image bearing body. The output voltage $V_c$ (V) of the d.c. power supply, and the distance $L_1$ (mm) from the contact position of the rotary member with the image bearing body to the contact position of the conductive member with the image bearing body in the feed direction of the image bearing body satisfy the relationship of the following equation (1):

$$\frac{V_C - 312}{6200} < L_1 < \alpha \cdot \log_e I_c + \beta \tag{1}$$

The factors α and β are defined by the following equations (2) and (3):

$$\alpha = -1.80(\log_{10}\rho s) + 11.39 \tag{2}$$

$$\beta = 1.98(\log_{10}\rho s) + 15.39 \tag{3}$$

The right side of equation (1) defines a condition under which there occurs no cleaning failure due to an excessive increase in the surface voltage $V_s$ of the rotary member. This condition was obtained by experiments. The left side of equation (1) defines a condition under which gap discharge does not occur between the rotary member and the conductive member. This condition was obtained by Paschen's law. If the direct current $I_C$ flowing between the rotary member and the conductive member via the image bearing body, the surface voltage $V_s$ of the rotary member, and the distance $L_1$ between the rotary member and the conductive member satisfy the relationship of equation (1), then successful cleaning performance can be obtained.

Preferably, the factor a is between or equal to −10.2 and −3.01, and the factor β is between or equal to 31.23 and 39.15.

The cleaning device may further include a second conductive member which makes contact with the image bearing body on an upstream side of the conductive member in the conveyance direction of the image bearing body. Preferably, the second conductive members is grounded. This second conductive member makes it possible to prevent powder smoke of the toner from scattering from the cleaning device to adhere to the image bearing body. The second conductive member functions also as a charge elimination member.

The cleaning device may also include a third conductive member which makes contact with the image bearing body on a downstream side of the rotary member in the conveyance direction of the image bearing body. Preferably, the third conductive member is connected to the d.c. power supply. This third conductive member prevents powder smoke of the toner derived from scattering out of the cleaning device. The third conductive member has a function of uniformizing the charging polarity of the toner on the image bearing body that has passed through the rotary member.

In a second aspect of the present invention, there is provided an image forming apparatus which has an image bearing body for carrying a toner image on a surface thereof. Also included may be a transfer section for transferring the toner image on the image bearing body surface onto a transfer-destination member by electric power fed from a first power supply. The apparatus may also include a current sensor for detecting a current flowing through the transfer section and a rotary member which is rotatably placed on a downstream side of the transfer section in a feed direction of the image bearing body so as to make contact with the image bearing body surface. Preferably, the rotary member is electrically conductive. A motor for rotating the rotary member may also be provided. A second power supply for supplying electric power to the rotary member, whereby toner remaining on the image bearing body surface after transfer is electrostatically adsorbed to the rotary member may also be provided. A controller for controlling either the output of the second power supply or the rotational speed of the motor based on a current value detected by the current sensor.

More specifically, the larger the current value detected by the current sensor is, the more the controller increases the output of the second power supply. Also, the larger the current value detected by the current sensor is, the more the controller increases the rotational speed of the motor in addition to or instead of the adjustment of the output of the second power supply.

The image forming apparatus may also include an environment sensor for detecting an environmental condition. In this case, the controller further controls at least one of the output of the first power supply and the rotational speed of the motor based on an environmental condition detected by the environment sensor. The environment sensor can detect temperature or humidity as the environmental condition, as an example.

The image forming apparatus may further comprise a size sensor for detecting size of the transfer-destination member. In this case, the controller controls at least one of the output of the first power supply and the rotational speed of the motor based on a size of the transfer-destination member detected by the size sensor.

The image forming apparatus may further comprise a toner quantity detection sensor for detecting the quantity of toner on the image bearing body surface. In this case, the controller controls at least one of the output of the first power supply and the rotational speed of the motor based on the detected toner quantity. The image forming apparatus may further comprise a jamming detection sensor for detecting occurrence of a jamming of the transfer-destination medium. The controller may control at least one of the output of the first power supply and the rotational speed of the motor based on a detection result of the jamming detection sensor. The controller may at least one of the output of the first power supply and the rotational speed of the motor by further taking into consideration other conditions such as the type of the transfer-destination member.

When the image bearing body is an intermediate transfer belt, the transfer section includes a secondary transfer roller that forms a nip portion, through which the transfer-destination member passes, against the surface of the intermediate transfer belt, and a stretching roller which is opposite to this secondary transfer roller and which contacts with the rear surface of the intermediate transfer belt, wherein the current sensor detects a current flowing through this stretching roller.

In a third aspect of the present invention, the image forming apparatus may include an image bearing body for carrying a toner image on a surface thereof, and an intermediate transfer member which contacts with the image bearing body. Also included may be a primary transfer section for transferring the toner image on the image bearing body surface to the intermediate transfer member by electric power being fed from a first power supply. A secondary transfer section may be placed on a downstream side of the primary transfer section in a feed direction of the intermediate transfer member and may transfer the toner image on the intermediate transfer member to a transfer-destination member. A rotary member may be placed on a downstream side of the secondary transfer section in the feed direction of the intermediate transfer member and may be rotatively driven while making contact with a surface of the intermediate transfer member. The rotary member may be electrically conductive. A second power supply for supplying electric power to the rotary member may be provided, whereby toner remaining on the intermediate transfer member even after the toner image has been transferred to the transfer-destination member is electrostatically adsorbed to the rotary member. A grounded conductive member which makes contact with the intermediate transfer member and which is electrically connected to the second power supply via the rotary member and the intermediate transfer member may also be included. A current sensor may detect a current flowing through the conductive member. A controller for controlling an output of the first power supply based on a current value detected by the current sensor be also be provided.

For instance, the conductive member is placed on the upstream side of the rotary member in the conveyance direction of the intermediate transfer member. When the intermediate transfer member is an intermediate transfer belt stretched on a plurality of stretching rollers, the conductive member may be one of the plurality of stretching rollers which is opposite to the rotary member.

More specifically, the controller adjusts an output voltage of the first power supply so that the current value detected by the current sensor does not exceed a predetermined threshold value.

A current flowing the conductive member electrically connected to the second power supply via the rotary member and the conductive member through is detected by the current sensor. When an excessive current flows through the intermediate transfer member in the primary transfer section for such reasons as resistance decreases of the intermediate transfer member due to endurance or humidity increases within the image forming apparatus, this current flows into the conductive member via the intermediate transfer member. As a result, the current value detected by the current sensor increases. That is, the current value detected by the current sensor serves as an index for indicating whether or not an excessive current is flowing through the intermediate transfer member in the primary transfer section. Accordingly, by the controller controlling the output of the first power supply based on the current detected by the current sensor, flow of an excessive current through the intermediate transfer member can be prevented. As a consequence, there is no possibility that the intermediate transfer member may be damaged by the flow of an excessive current, and thus the serve life of the intermediate transfer member can be prolonged.

BRIEF DESCRIPTION OF THE DRAWINGS

These and other objects and features of the invention will become apparent from the following description taken in conjunction with preferred embodiments of the invention with reference to the accompanying drawings, in which.

DETAILED DESCRIPTION OF THE PREFERRED EMBODIMENTS

The embodiment of the present invention will now be described in detail with reference to the accompanying drawings.

(First Embodiment)

Figure 1:
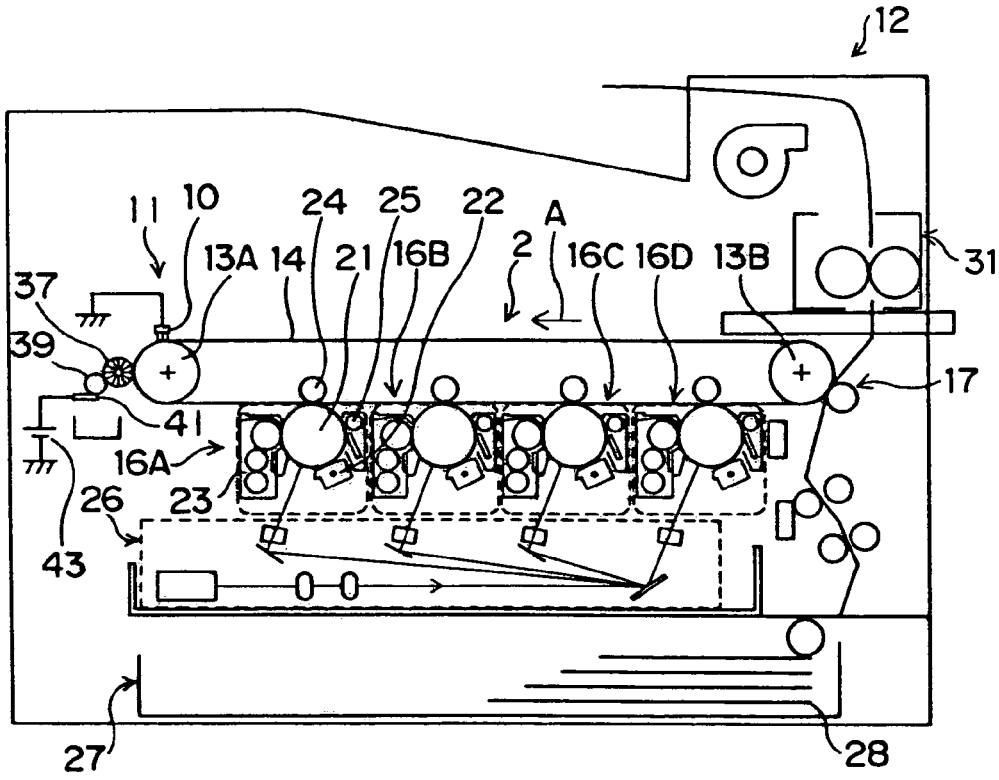
FIG. 1 is a schematic view showing a laser printer having a cleaning device according to a first embodiment of the present invention.

FIG. 1 shows a laser printer 12 of tandem process method exemplifying an image forming apparatus having a secondary cleaning device 11 (hereinbelow referred to as a cleaning device 11) according to a first embodiment-of the present invention. It is to be noted that in the present embodiment, a normal charge polarity of toner is negative.

An intermediate transfer belt 14 (hereinbelow referred to as a transfer belt 14) stretched between a pair of stretching rollers 13A and 13B is forwarded to a direction shown with an arrow A by rotation of the stretching rollers 13A, 13B. Around the transfer belt 14, there are disposed first to fourth image forming units 16A–16D, a secondary transfer device 17, and a cleaning device 11.

The image forming units 16A–16D each transfer images in yellow (Y), magenta (M), cyan (C) and black (Br) to the transfer belt 14. The image forming units 16A–16D have the same structure, in which a charging device 22, a developing device 23, a primary transfer device 24, and a primary cleaning device 25 are provided around a photoconductor drum 21. The surface of the photoconductor drum 21 that is evenly charged by the charging device 22 is exposed to a laser beam radiated from a laser device 26 to form an electrostatic latent image. The electrostatic latent image is developed into a toner image with toner supplied by the developing device 23. The toner image is transferred onto the surface of the transfer belt 14 with a positive voltage that is applied to the back surface side of the transfer belt 14 by the primary transfer device 24. Toner remaining on the surface of the photoconductor drum 21 after this primary transfer is collected by the primary cleaning device 25.

Every time the transfer belt 14 passes through the image forming units 16A–16D, toner images are transferred onto the transfer belt 14 in the state of being superposed on each other (it is to be noted that in the case of a monochrome image, a toner image is transferred onto the transfer belt 14 only by the image forming unit 16D). The transferred toner image is transferred onto a record medium 28 such as a paper sheet that is transported from a sheet feed cassette 27 by the secondary transfer device 17. More specifically, with a positive voltage applied to the back surface of the record medium 28, the toner image is transferred from the transfer belt 14 to the record medium 28. Toner 30 remaining on the transfer belt 14 after the transfer by the secondary transfer device 17 includes toner charged with a normal charge polarity (negative) as well as toner charged with a reverse polarity (positive). The recording medium 28 onto which the toner image is transferred is sent to a fixing device 31, and then the toner image is fixed to the record medium 28 through pressurization and heating.

The cleaning device 11 is described with reference to FIG. 2 and FIG. 3. The cleaning device 11 is provided with a collection section 35 for collecting the toner 30 and a discharging section 36 that is positioned upstream with respect to the collection section 35 in a transportation direction of the intermediate gear 14. The discharging section 36 unifies the polarity of the toner 30 that is charged with a reverse polarity.

The collection section 35 has a fur brush (rotational member) 37 that comes into contact with the surface of the transfer belt 14. The fur brush 37 is formed by implanting resinous hairs having a resistance of, for example, about $1\times10^4$ to $1\times10^7$ Ω/□ around a cored bar 37*a*. The fur brush 37 is driven to be rotated in a direction opposite to a forward direction of the transfer belt 14 by a motor 38A. The fur brush 37 is in contact with a metallic collection roller 39 having conductivity. The collection roller 39 is driven to be rotated in a direction opposite to the fur brush 37 by a motor 38B. Moreover, the collection roller 39 is in contact with a metallic scraper 41 that has conductivity so as to function as an electrical contact member. With reference to FIG. 3, a width W1 of the fur brush 37 is larger than a maximum width W2 of the record medium 28 and is smaller than a width W3 of the transfer belt 14. Therefore, regardless of the size of the record medium 28, there are regions ΔW on the both side portions of the transfer belt 14, in which the fur brush 37 and the transfer belt 14 face each other without the presence of the recording medium 28 interposed therebetween.

The discharging section 36 has a conductive brush (conductive member) 42 that is formed by implanting resinous hairs having resistance in a conductive metallic base portion. The power supply 43 is in contact with the surface of the transfer belt 14.

The fur brush 37 of the collection section 35 is electrically connected to a regulated or constant-current d.c. power supply 43. More particularly, one end of the scraper 41 is connected to the constant-current d.c. power supply 43, thereby the fur brush 37 is indirectly connected to the constant-current d.c. power supply 43 via the scraper 41 and the collection roller 39. The constant-current d.c. power supply 43 is connected to the fur brush 37 so as to generate a cleaning electric field with a polarity reverse to a normal charge polarity of the toner 30. In this embodiment, the normal charge polarity of the toner 30 is negative as described above, and so a positive terminal of the constant-current d.c. power supply 43 is connected to the fur brush 37 via the scraper 41 and the collection roller 39. The base portion 42 of the discharging section 36 is simply grounded without being connected to the power supply.

Figure 4:
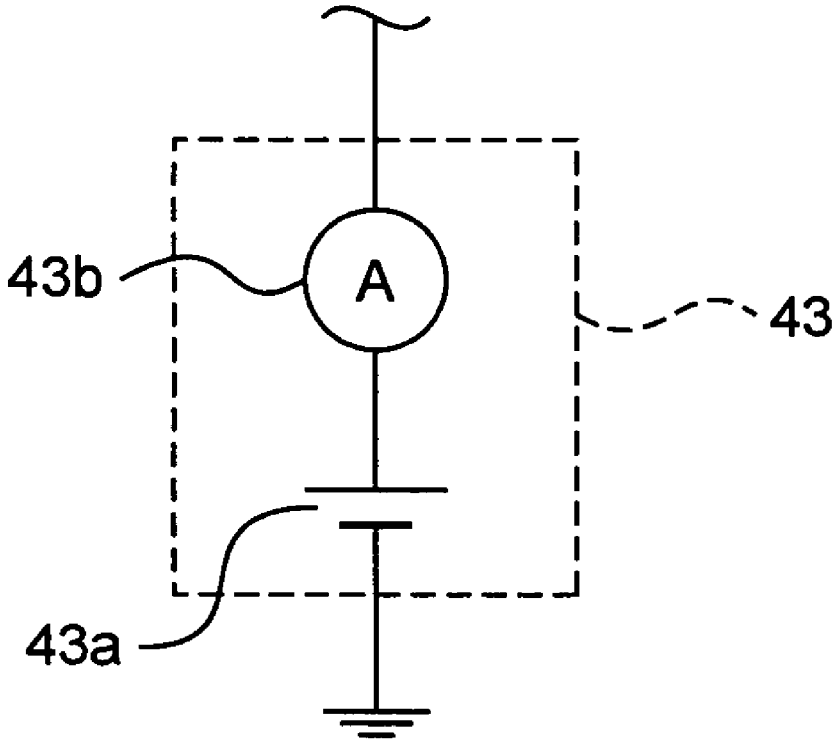
FIG. 4 is a schematic circuitry view showing a constant-current d.c. power supply.

As shown in FIG. 4, the constant-current d.c. power supply 43 includes a d.c. power supply 43*a* and a current sensing element 43*b* connected in series to the d.c. power supply 43*a*, and has a function of controlling the output voltage so as to maintain the current value constant.

Figure 2:
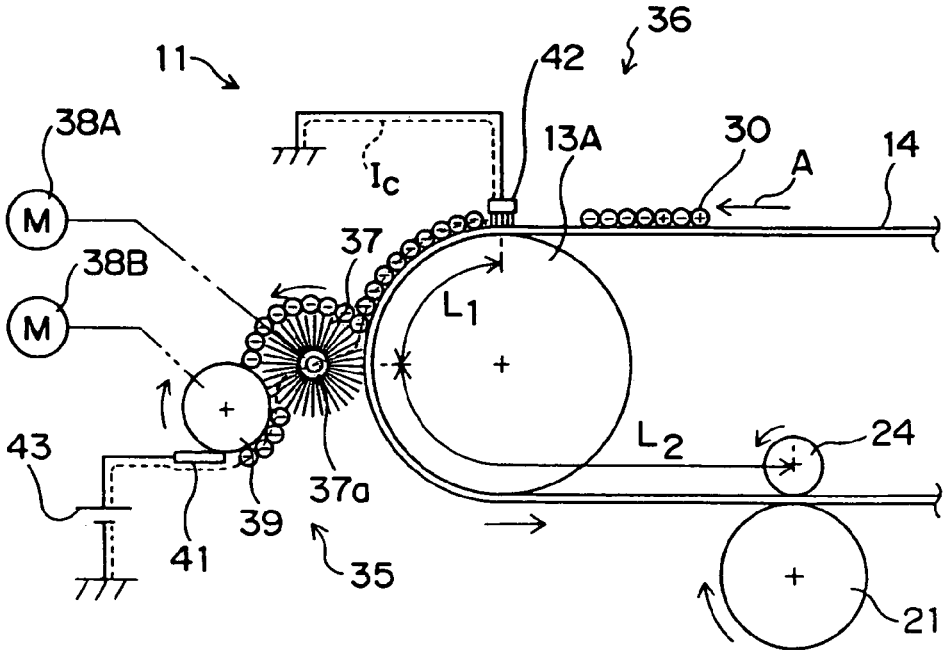
FIG. 2 is a schematic view showing the cleaning device according to the first embodiment of the present invention.
Figure 3:
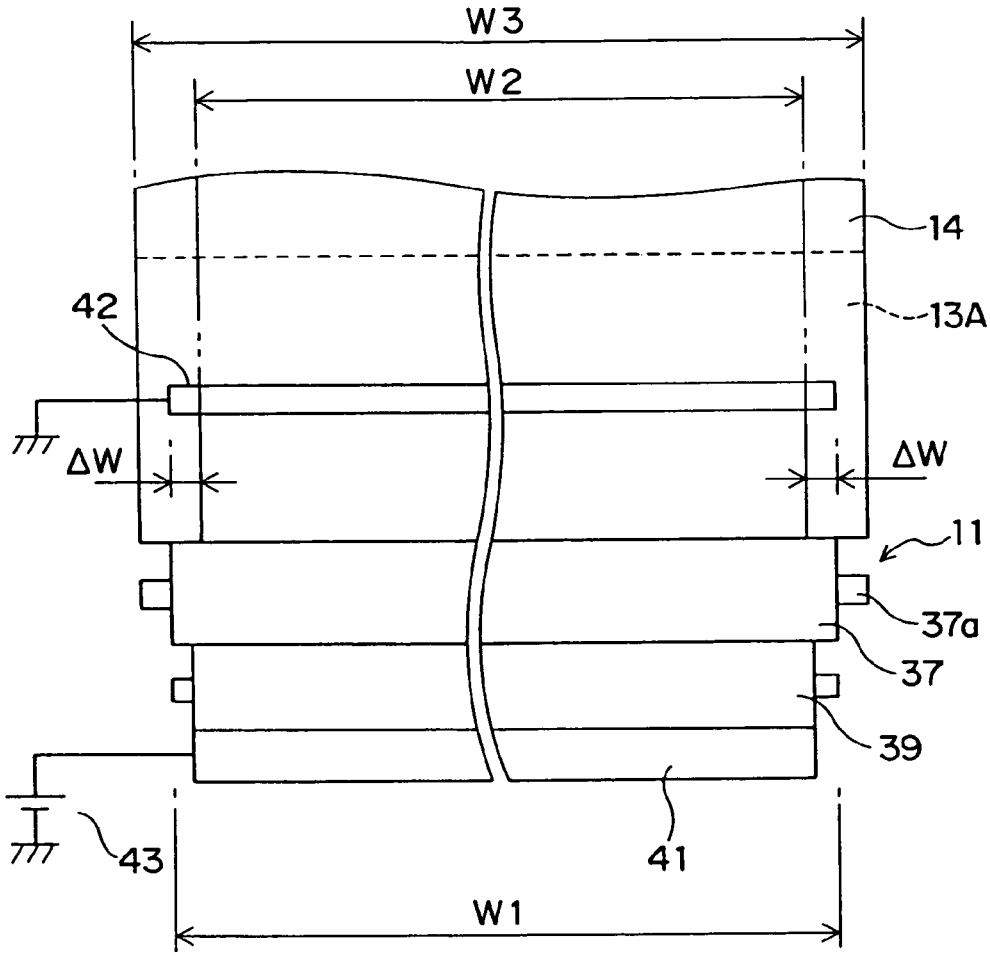
FIG. 3 is a plane view showing the cleaning device according to the first embodiment of the present invention.
Figure 5A:
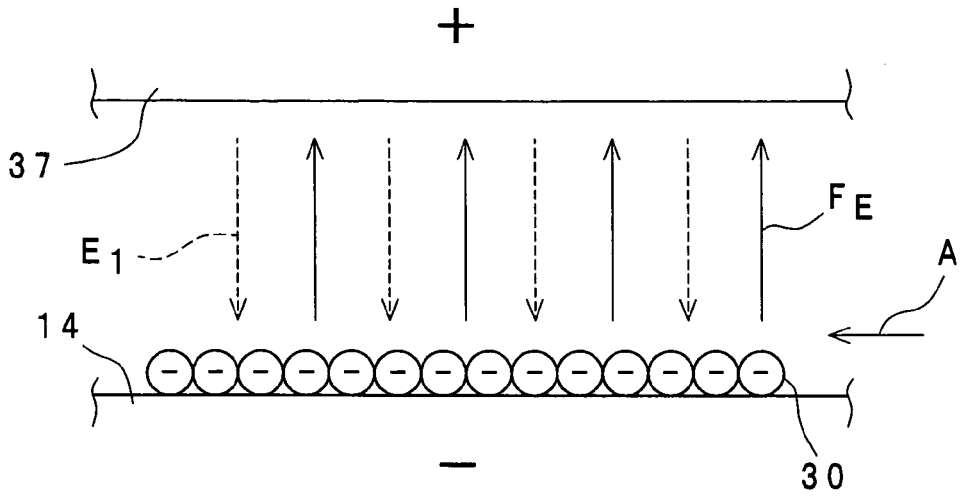
FIG. 5A is a schematic view showing a cleaning electric field generated in a collection section.

As shown in a dot line in FIG. 2, a cleaning current $I_C$ flows from the constant-current d.c. power supply 43 through the scraper 41, the collection roller 39, the fur brush 37, and the transfer belt 14 to the base portion 42. With reference to FIG. 5A, between the fur brush 37 and the transfer belt 14 in the collection section 35, there is generated an electric field (cleaning electric field) $E_1$ with a polarity on the opposite side of a normal charge polarity of the toner 30, i.e., the electric field directed from the fur brush 37 to the transfer belt 14. As shown with an arrow $F_E$, the cleaning electric field E1 causes a force of electrostatically adsorbing the toner 30 with a normal charge polarity (negative) presented on the surface of the transfer belt 14 toward the fur brush 37. The toner 30 is collected from the transfer belt 14 by being electrostatically adsorbed to the fur brush 37. Due to an electric potential difference between the fur brush 37 and the collection roller 39, the toner 30 adsorbed to the surface of the fur brush 37 is moved to the collection roller 39, and is scraped off from the surface of the collection roller 39 by the scraper 41.

Figure 5B:
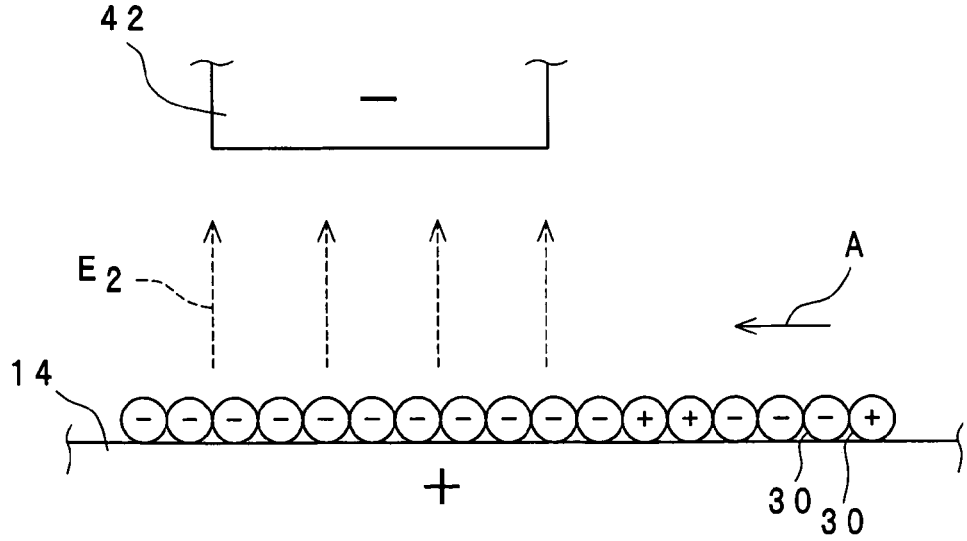
FIG. 5B is a schematic view showing an electric field generated in a discharge section.

Also with reference to FIG. 5B, between a conductive brush 42 and the transfer belt 14 in the discharging section 36, there is generated an electric field $E_2$ (electric field opposite to the cleaning electric field $E_1$) with a polarity on the same side of the normal charge polarity of the toner 30. Due to the electric field $E_2$, the toner 30 charged with a polarity reverse to that on the surface of the transfer belt 14 become to have the normal charge polarity (negative) when they pass through the conductive brush 42. Therefore, the toner 30 with a charge polarity that has been unified to be the normal charge polarity reaches the fur brush 37, and the fur brush 37 allows the toner 30 to be effectively collected from the transfer belt 14.

As described before, the electric fields $E_1$ and $E_2$ which are different in direction from each other are generated in the collection section 35 and the discharging section 36. These electric fields $E_1$ and $E_2$ are generated by the cleaning current $I_C$ that flows from the fur brush 37 of the collection section 35 connected to the constant-current d.c. power supply 43 to the conductive brush 42 of the discharging section 36 via the transfer belt 14. Only the fur brush 37 of the collection section 35 is connected to the constant-current d.c. power supply 43 while the conductive brush 42 of the discharging section 36 is grounded. In other words, only a single constant-current d.c. power supply 43 functions as a power supply for giving charges or generating an electric field. This achieves downsizing of the device and reduction of costs.

The constant-current d.c. power supply 43 has a rated current of, for example, 10 to 100 μA, and a maximum voltage of, for example, about 0.3 to 4 kV. In order to generate an electric field with sufficient intensity in the collection section 35 and the discharging section 36, a resistance of the transfer belt 14 should preferably be, for example, $1\times10^8$ Ω/□ or more and $1\times10^{12}$ Ω/□ or less. Materials such as polyimide, polycarbonate and polyphenylene sulfide can be used for the transfer belt 14.

Moreover, as a power supply for generating an electric field, the constant-current d.c. power supply 43 is used. Consequently, even if a resistance is increased by adhesion of the toner 30 to the fur brush 37, the collection roller 39, or the conductive brush 42, and by change in duration of the transfer belt 14 and the like, a constant amount of current flows. Therefore, even with increase in resistance, it is possible to maintain the field intensity of the collection section 35 and the discharging section 36, resulting in prevention of deterioration of the collection efficiency.

Further, a current fed by the constant-current d.c. power supply 43 flows between the fur brush 37 of the collection section 35 and the conductive brush 42 of the discharging section 36 via the transfer belt 14. This eliminates the need for grounding the stretching roller 13A that faces the collection section 35 and the discharging section 36 with the transfer belt 14 interposed therebetween. For this reason, in the present embodiment, the stretching roller 13A, which is a conductive roller, is maintained in an electrically floating state by supporting an axis thereof with a bearing made of an insulating resin. Therefore, even in the case of disposing the cleaning device 11 adjacent to the primary transfer device 24 and the secondary transfer device 17 for the sake of downsizing, it is possible to prevent a transfer current from the primary transfer or secondary device 24, 27 from flowing into the stretching roller 13A via the transfer belt 14. This allows prevention of a transfer failure due to influx of the transfer current and an image failure attributed to the transfer failure.

The conductive brush 42 of the discharging section 36 needs to be disposed at a position not in contact with the fur brush 37 of the collection section 35. For example, a distance $L_1$ from a nip portion of the fur brush 37 against the transfer belt 14 to a contact position of the conductive brush 42 to the transfer belt 14 in a forward direction of the transfer belt 14 should be set at ½ or more of a diameter of the fur brush 37. A preferable setting range of the distance $L_1$ will be described later in detail.

In order to ensure prevention of influx of a transfer current from the primary transfer device 24 and the secondary transfer device 17, the distance $L_1$ between the fur brush 37 and the conductive brush 42 should preferably be smaller than a distance between the fur brush 37 and the closest primary transfer device 24 or the secondary transfer device 17. In this embodiment, the primary transfer device 24 of the image forming unit 16A is closest to the fur brush 37. Therefore, the distance $L_1$ is smaller than the forward-direction distance L2 from the nip portion of the fur brush 37 against the transfer belt 14 to a nip portion of the primary transfer device 24 of the image forming unit 16A.

(Second Embodiment)

Figure 6:
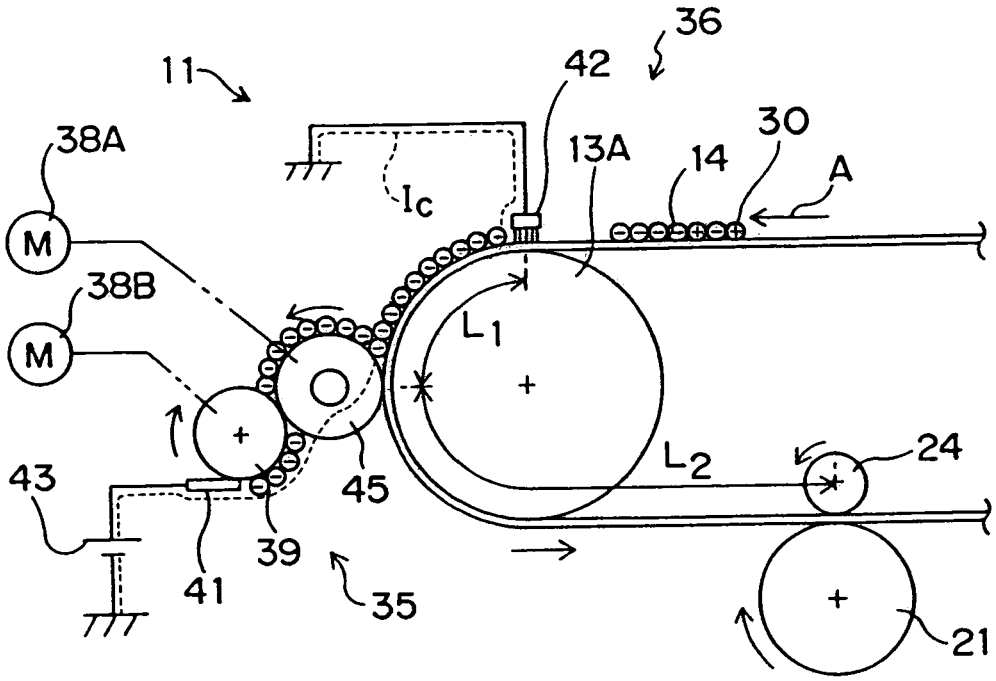
FIG. 6 is a schematic view showing a cleaning device according to a second embodiment of the present invention.

In a second embodiment of the present invention shown in FIG. 6, instead of the fur brush 37 (see FIG. 2), the collection section 35 is provided with a conductive elastic roller 45 having a conductive rubber layer on the perimeter of a core metal. Other structure and operation of the second embodiment are similar to those of the first embodiment.

(Third Embodiment)

Figure 7:
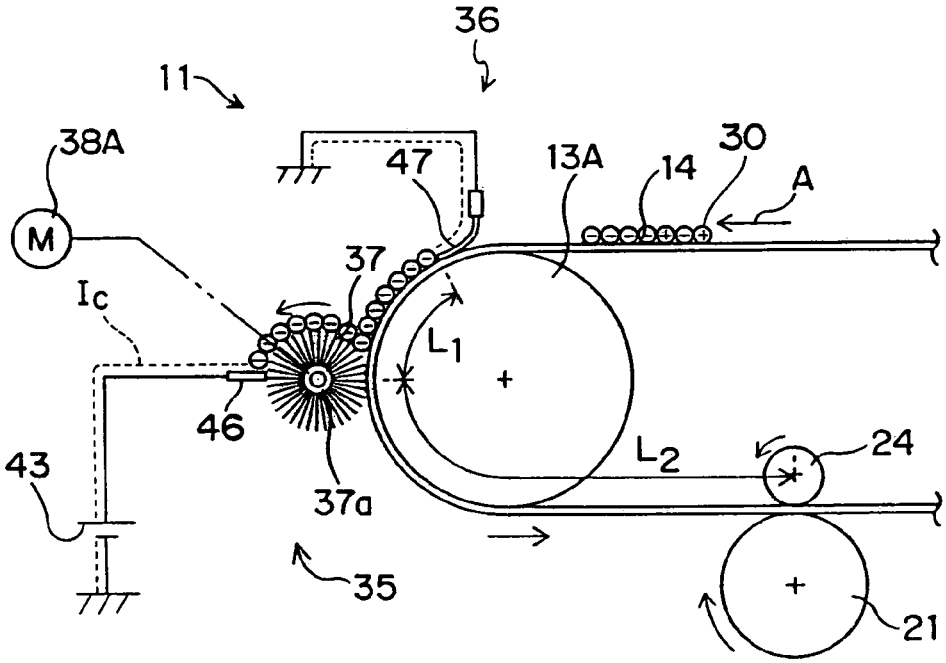
FIG. 7 is a schematic view showing a cleaning device according to a third embodiment of the present invention.

In a third embodiment of the present invention shown in FIG. 7, the fur brush 37 of the collection section 35 has conductivity and is connected to the constant-current d.c. power supply 43 via a flicker 46 that functions also as a contact member. The toner 30 collected by the fur brush 37 is scraped off by the flicker 46. Moreover, instead of the conductive brush 42 (see FIG. 2), the discharging section 36 is provided with a conductive film 47. The distal end side of the conductive film 47 is in contact with the transfer belt 14, while its proximal end side is supported by a holder having conductivity. The conductive film 47 is grounded via the holder. Cleaning current $I_C$ flows from the constant-current d.c. power supply 43 through the flicker 46, the fur brush 37, and the transfer belt 14 to the conductive film 47. Other structure and operation of the third embodiment are similar to those of the first embodiment.

(Fourth Embodiment)

Figure 8:
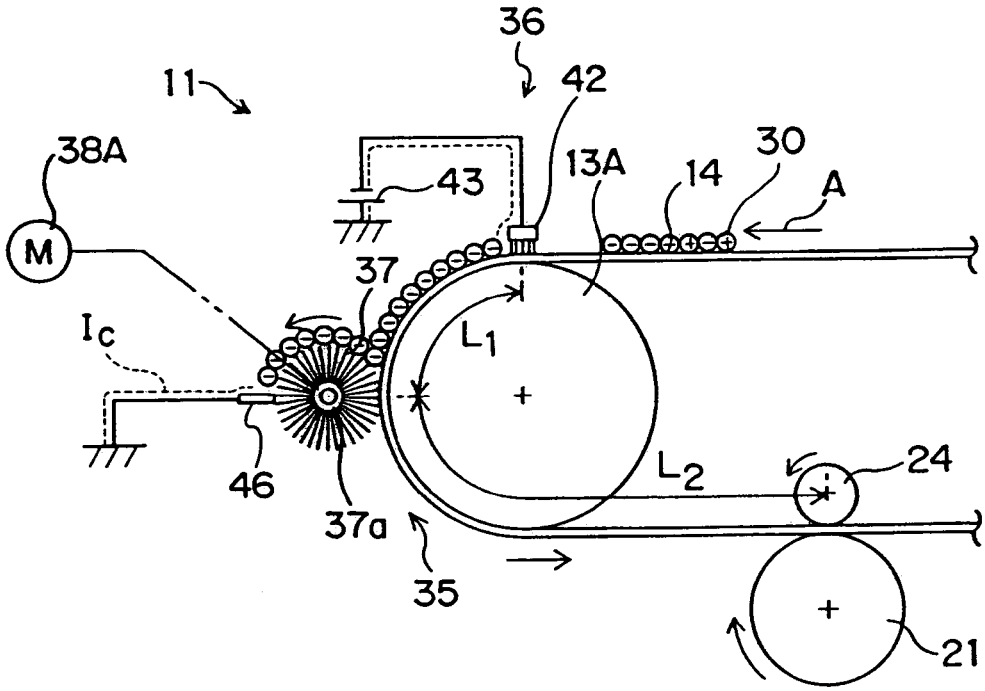
FIG. 8 is a schematic view showing a cleaning device according to a fourth embodiment of the present invention.

In a fourth embodiment of the present invention shown in FIG. 8, the conductive brush 42 of the discharging section 36 is connected to the constant-current d.c. power supply 43, and the fur brush 37 of the collection section 35 is grounded via the flicker 46. A negative terminal of the constant-current d.c. power supply 43 is connected to the conductive brush 42. By the cleaning current $I_C$ flowing from the constant-current d.c. power supply 43 through the conductive brush 42 and the transfer belt 14 to the fur brush 37, a cleaning electric field $E_1$ with a polarity reverse to a normal charge polarity of the toner 30 is generated in the fur brush 37, whereas an electric field $E_2$ with a polarity reverse to that of the cleaning electric field is generated in the conductive brush 42. Other structure and operation of the fourth embodiment are similar to those of the first embodiment.

(Fifth Embodiment)

Figure 9:
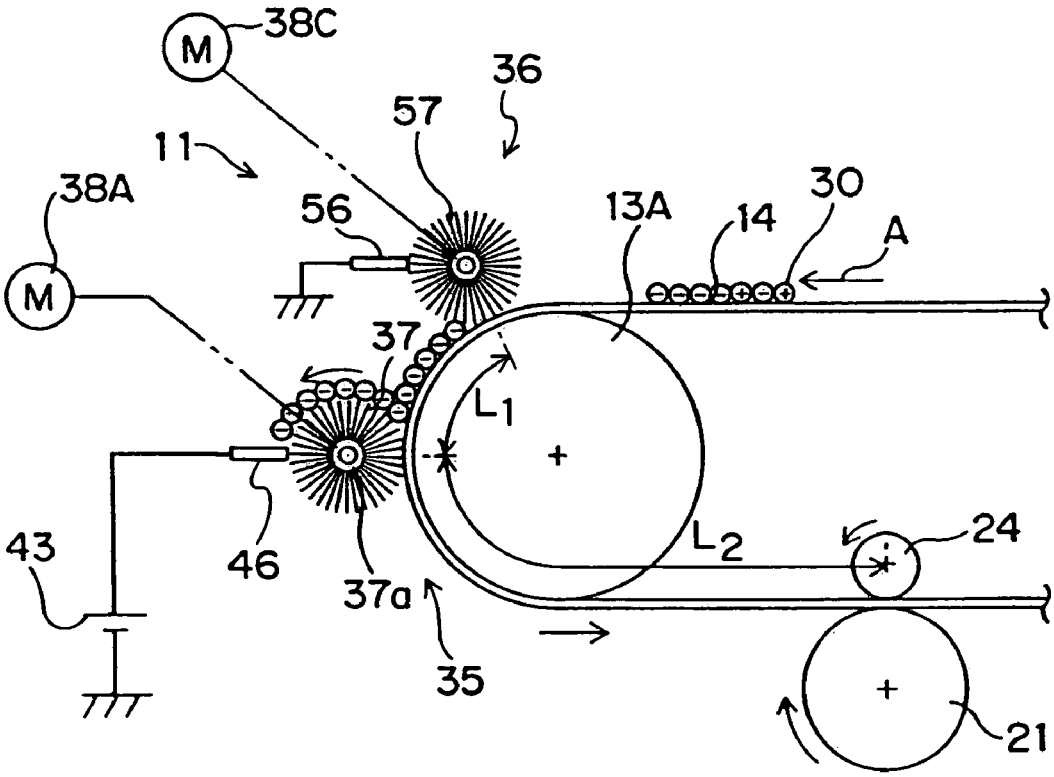
FIG. 9 is a schematic view showing a cleaning device according to a fifth embodiment of the present invention.

In a fifth embodiment of the present invention shown in FIG. 9, a conductive brush 37 of the collection section 35 is connected to the constant-current d.c. power supply 43 via the flicker 46. Moreover, the discharging section 36 is provided with a fur brush 57 that is grounded via a flicker 56. The fur brush 57 is driven to be rotated in a direction opposite to the forward direction of the transfer belt 14 by a motor 38C. Other structure and operation of the fifth embodiment are similar to those of the first embodiment.

(Sixth Embodiment)

Figure 10:
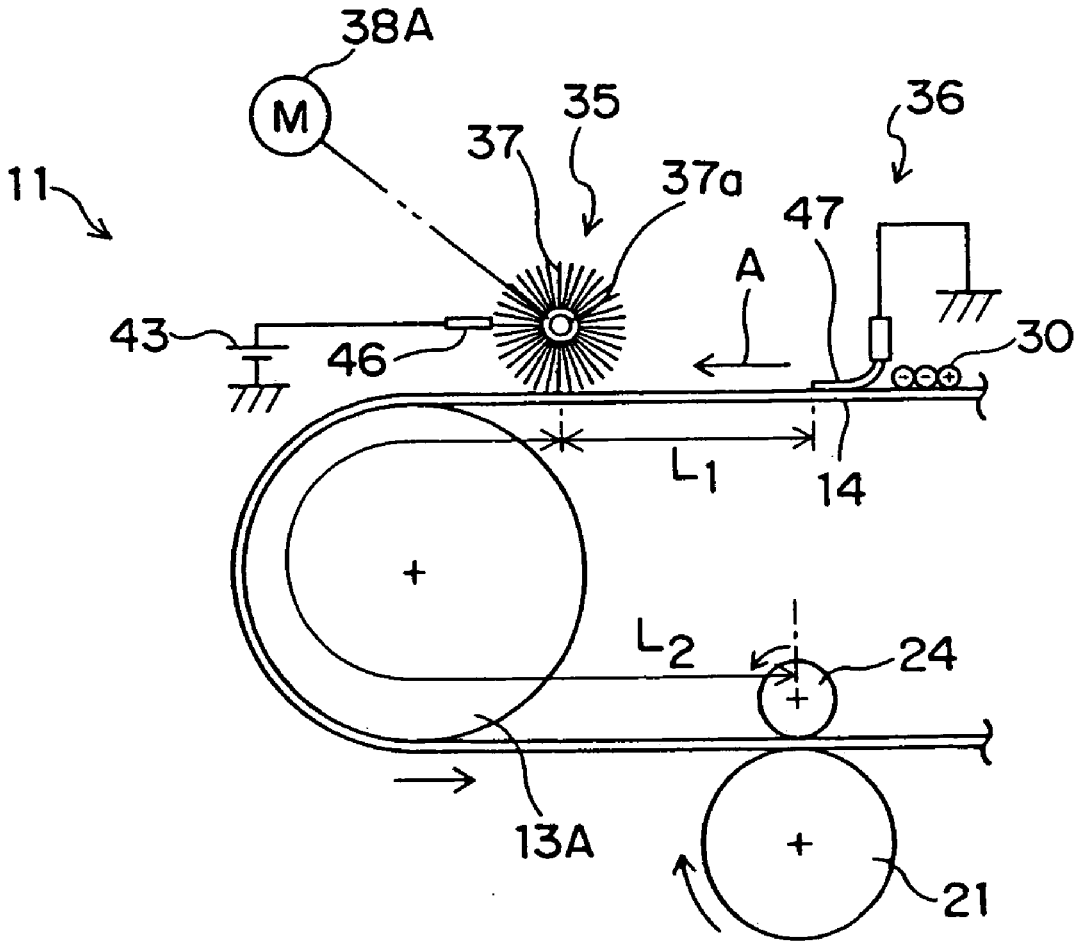
FIG. 10 is a schematic view showing a cleaning device according to a sixth embodiment of the present invention.
Figure 11:
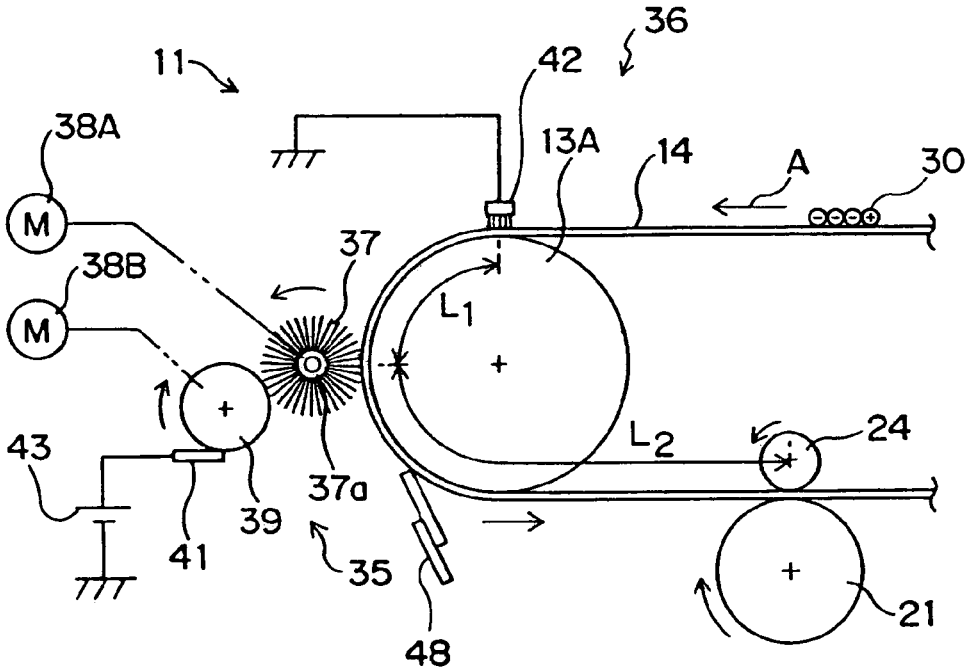
FIG. 11 is a schematic view showing a cleaning device according to a seventh embodiment of the present invention.

In a sixth embodiment of the present invention shown in FIG. 10, the collection section 35 having the fur brush 37 connected to the constant-current d.c. power supply 43 via the flicker 46, and the discharging section 36 having a grounded conductive film 47 are disposed on the side closer to the secondary transfer device 17 (upstream in a transportation direction of the transfer belt 14) than in the first to fifth embodiments. Thus, the cleaning device of the present invention can be disposed in an arbitrary position along on the transfer belt 14 under a condition that the distance from the collection section 35 to the discharging section 36 (distance $L_1$) is smaller than the distance between the collection section 35 and the closest primary transfer device 9 or the secondary transfer device 17 (distance $L_2$).

(Seventh Embodiment)

In a seventh embodiment of the present invention shown in FIG. 7, in addition to a cleaning device 11 with the same structure as the first embodiment, a cleaning blade 48 is provided downstream in a forward direction of the transfer belt 14. The distal end of the cleaning blade 48 is in contact with the transfer belt 14, and the toner 30 that has passed through the collection section 35 is removed from the surface of the transfer belt 14 by the cleaning blade 48. Other structure and operation of the seventh embodiment are similar to those of the first embodiment.

(Eighth Embodiment)

Figure 12:
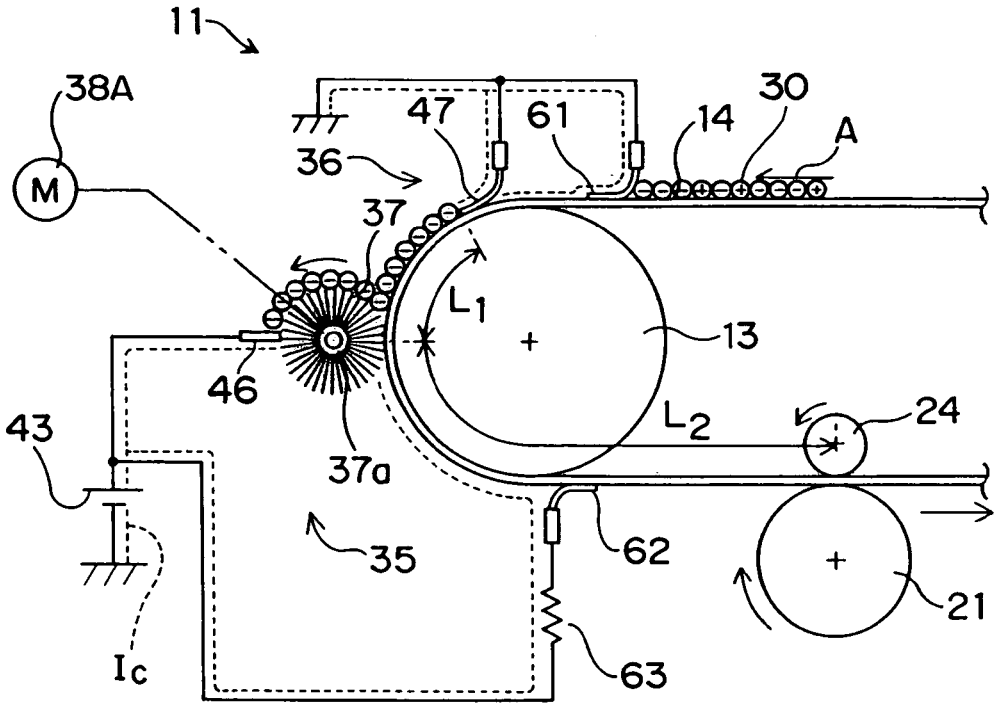
FIG. 12 is a schematic view showing a cleaning device according to an eighth embodiment of the present invention.

In an eighth embodiment of the invention shown in FIG. 12, with a spacing to the conductive film 47 of the discharging section 36, another conductive film 61 is provided on the upstream side in the feed direction of the transfer belt 14. This conductive film 61 is in contact with the transfer belt 14 on its distal end side, while supported on its proximal end side by a holder having conductivity. The conductive film 61 is grounded.

By the provision of the conductive film 61, the interior of the cleaning device 11 is sealed, so that the possibility that powder smoke of the toner 30 generated by the fur brush 37 may diffuse outside the cleaning device 11 to re-adhere to the transfer belt 14 can be prevented. In order to securely seal the powder smoke of the toner 30, the conductive film 61 preferably has enough flexibility and tightly contacts with the transfer belt 14. Therefore, the conductive film 61 is preferably made of a material lower in hardness than the conductive film 47 of the discharging section 36 and smaller in thickness than conductive film 47.

Since the conductive film 61 is grounded, part of the cleaning current $I_C$ flows into the conductive film 61 from the constant-current d.c. power supply 43 via the flicker 46, the fur brush 37, and the transfer belt 14. This current generates an electric field between the conductive film 61 and the transfer belt 14 so that the electric is directed in the same direction as the electric field $E_2$ between the conductive film 47 and the transfer belt 14 in the charge-eliminating section 36 (see FIG. 5B). Therefore, the conductive film 61 preliminary uniformizes the charge of the toner 30 remaining on the transfer belt 14 before its reaching the charge-eliminating section 36. Thus, this conductive film 61 allows the discharging performance to be improved as a whole of the cleaning device 11. In addition, a resistor may be interposed between the conductive film 61 and the grounding portion in order to adjust the strength of the electric field generated between the conductive film 61 and the transfer belt 14.

An insulative film may also be adopted instead of the conductive film 61. This insulative film indeed does not have the static elimination function, but can seal the powder smoke of the toner 30 generated by the fur brush 37.

Another conductive film 62 is provided with a spacing to the fur brush 37 of the collection section 35 in the feed direction of the transfer belt 14. This conductive film 62 is in contact with the transfer belt at its distal end side 14, while supported on its proximal end side by a holder having conductivity. The conductive film 62 is connected to the d.c. power supply 43 via a resistor 63.

Like the conductive film 61 disposed on the upstream side of the discharging section 36, the conductive film 62 prevents powder smoke of the toner 30 generated by the fur brush 37 from diffusing outside the cleaning device 11.

Since the conductive film 62 is in contact with the transfer belt 14, part of the cleaning current $I_C$ derived from the constant-current d.c. power supply 43 flows into the transfer belt 14 via the conductive film 62. By this current, an electric field of the same direction as the electric field $E_2$ generated between the conductive film 47 and the transfer belt 14 in the charge-eliminating section 36 (see FIG. 5B) is generated between the conductive film 62 and the transfer belt 14. Therefore, the conductive film 62 has a function of uniformizing the charge polarity of the toner 30 on the transfer belt 14 that has passed through the collection section 35 without being collected by the fur brush 37.

Figure 13:
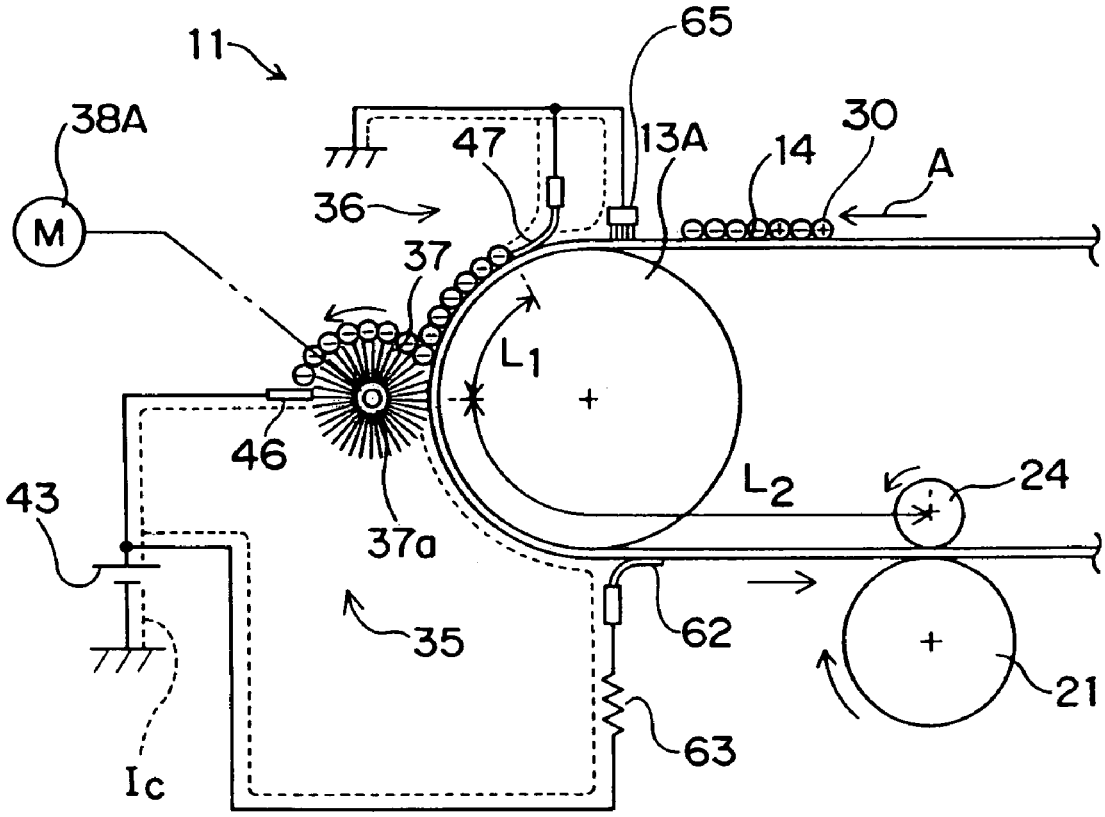
FIG. 13 is a schematic view showing a cleaning device of a modified example of the eighth embodiment of the present invention.
Figure 14:
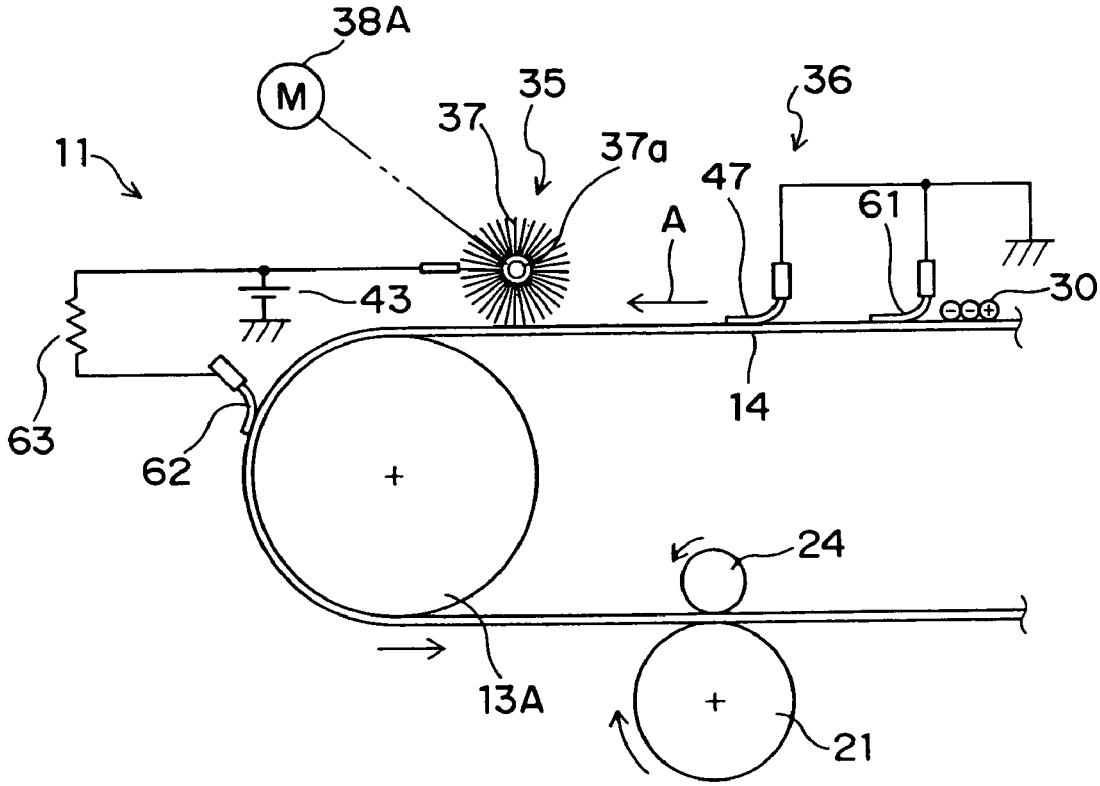
FIG. 14 is a schematic view showing a cleaning device of a modified example of the eighth embodiment of the present invention.

Instead of the conductive film 61 upstream of the discharging section 36 in the feed direction of the transfer belt 14, a conductive brush 65 may be provided as shown in FIG. 13. The conductive brush 65 has no function of sealing the powder smoke of the toner 30, but discharges static charge of the residual toner 30 on the transfer belt 14. Likewise, the conductive film 62 on the downstream side of the collection section 35 in the feed direction of the transfer belt 14 may be replaced with a conductive brush. Further, as shown in FIG. 14, the cleaning device 11 of FIG. 12 may be disposed at more upstream side of the transfer belt 14. Furthermore, the cleaning device 11 may be provided with either one of the conductive films 61 and 62.

As a result of experiments and analyses, the present inventors have found out that the cleaning devices 11 of the first to eighth embodiments exert proper cleaning performance when conditions defined by the following equation (4) are satisfied:

$$\frac{V_C - 312}{6200} < L_1 < \alpha \cdot \log_e I_c + \beta \tag{4}$$

In equation (4), $I_C$ represents a cleaning current (μA) flowing between a rotary member (fur brush 37 or conductive roller 45) of the collection section 35 and a conductive member (conductive brush 42, conductive film 47, or fur brush 57) of the charge-eliminating section 36 via the transfer belt 14 as an image bearing body. Also, $V_c$ represents an output voltage (V) of the constant-current d.c. power supply 43. Further, $L_1$ represents a distance (mm) in the feed direction of the transfer belt 14 from the contact position of the rotary member with the transfer belt 14 to the contact position of the conductive member with the transfer belt 14.

In equation (4), α and β are factors related to the surface resistance of the transfer belt 14. The factors of the transfer belt 14 are defined by the following equations (5) and (6):

$$\alpha = -1.80(\log_{10}\rho s) + 11.39 \tag{5}$$

$$\beta = 1.98(\log_{10}\rho s) + 15.39 \tag{6}$$

The right side of equation (4) was obtained from experiments related to the distance $L_1$, the cleaning current $I_C$ and the surface resistance ρs of the transfer belt 14. In the experiments, the cleaning device 11 of the first embodiment shown in FIGS. 1 to 3 was used. As described before, in the first embodiment, the rotary member of the collection section 35 is the fur brush 37, and the conductive member of the discharging section 36 is the conductive member 42. The transfer belt 14, which was made of polycarbonate, had a width W3 (see FIG. 3) of 350 mm and a film thickness of 150 μm. Also, the fur brush 37, which was equipped with fur of conductive nylon, had an outer diameter of 15.4 mm, an axial direction or width W1 of 310 mm and a resistance of $1\times10^9$ Ω. Further, the conductive brush 42, which was equipped with fur of conductive nylon, had a fur length of 5 mm, an axial length or width of 310 mm and a resistance of $1\times10^9$ Ω.

Figure 15:
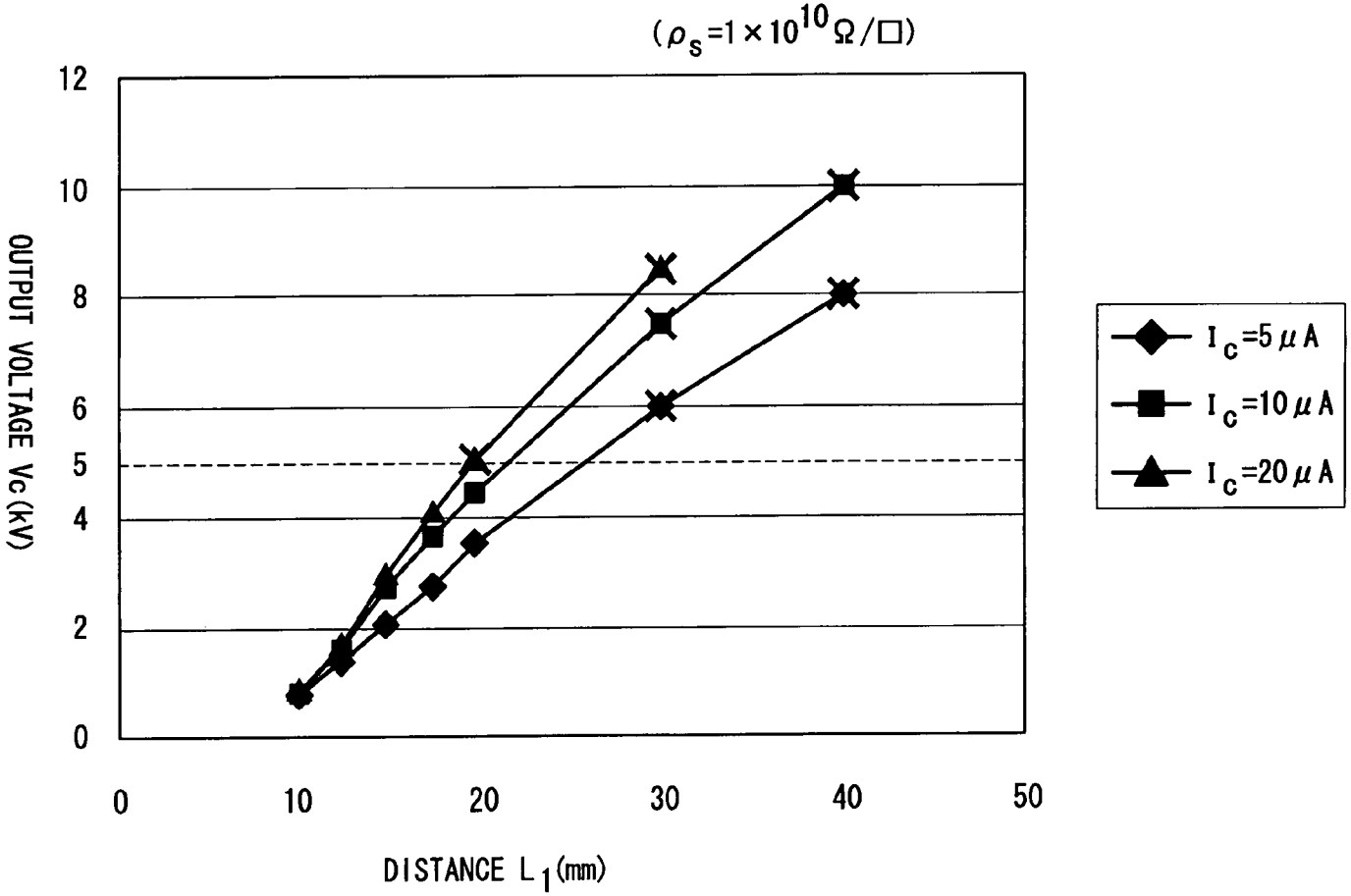
FIG. 15 is a graph view showing a relation between distance $L_1$ and voltage when the surface resistance of the transfer belt is $1\times10^{10}$ Ω/□.
Figure 16:
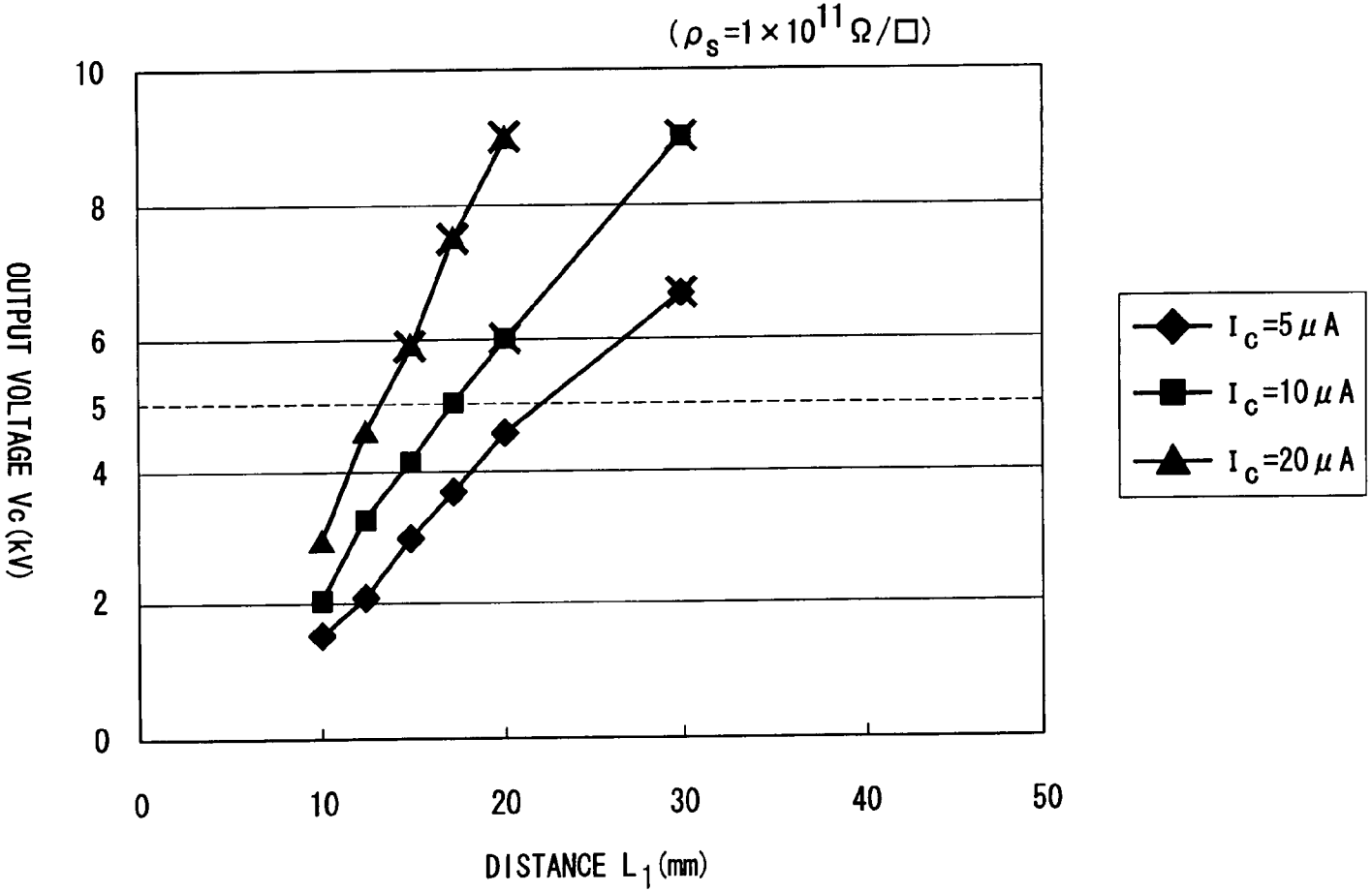
FIG. 16 is a graph view showing a relation between distance $L_1$ and voltage when the surface resistance of the transfer belt is $1\times10^{11}$ Ω/□.

First, the relation between the distance $L_1$ from the fur brush 37 to the conductive brush 42, and the output voltage $V_c$ of the constant-current d.c. power supply 43 was analyzed. Specifically, on cases where the cleaning current $I_C$ was 5 μA, 10 μA, and 20 μA, the output voltage $V_c$ was measured with the distances $L_1$ varied. FIG. 15 shows a measurement result in the case where the surface resistance ρs of the transfer belt 14 was $1\times10^{10}$ Ω/□, and FIG. 16 shows measurement result in the case where the surface resistance ρs was $1\times10^{11}$ Ω/□. In FIGS. 15 and 16, the symbol "x" shows that a cleaning failure occurred. The cleaning failure was determined by the following manner. First, toner remaining on the transfer belt 14 after the passage through the cleaning device 11 was put onto adhesive tape. Then, concentration of the toner adhering on the adhesive tape was measured, where if the measured value was higher than a predetermined threshold value, it was determined as a cleaning failure.

Figure 17:
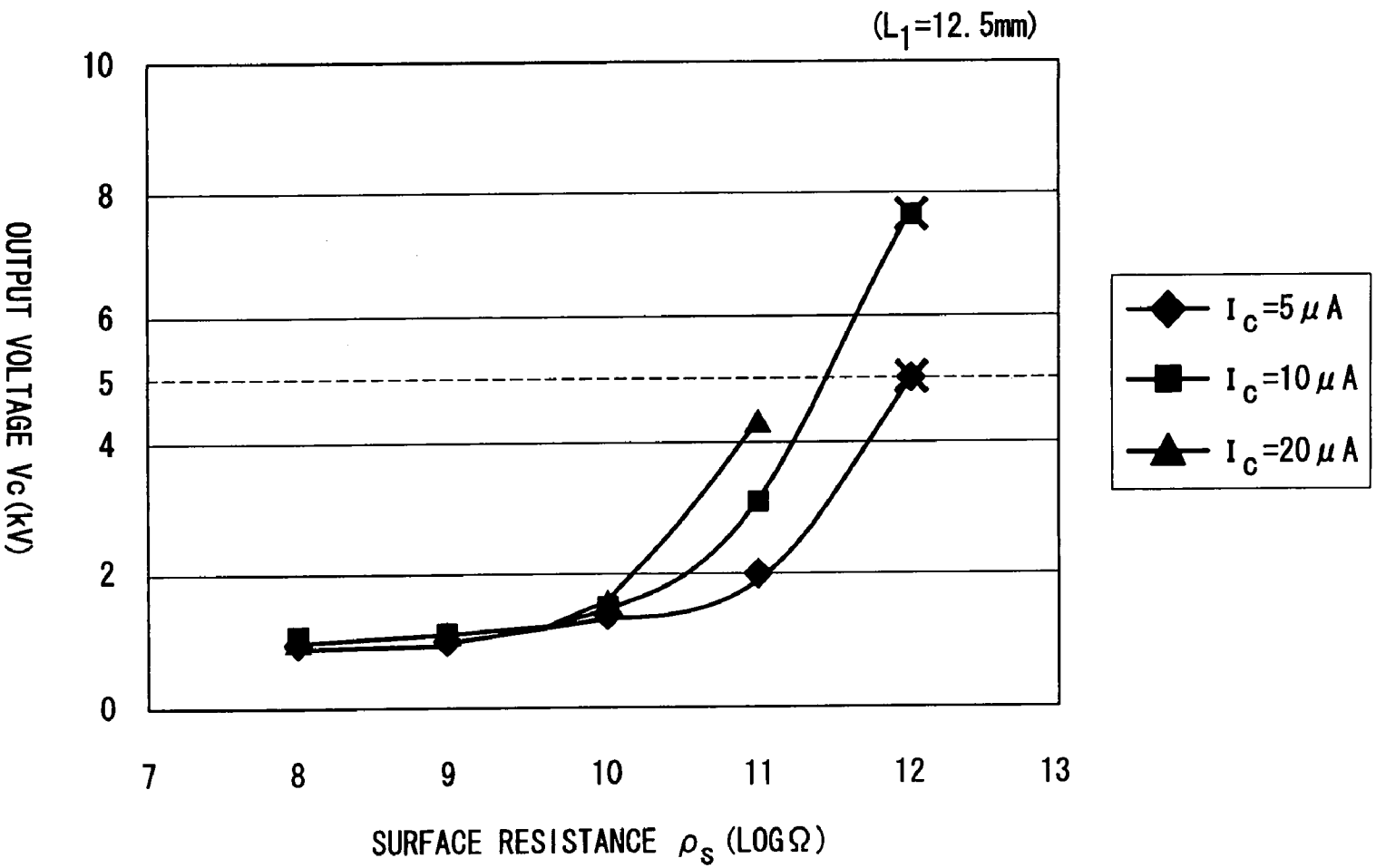
FIG. 17 is a graph view showing a relation between the surface resistance and the voltage of the transfer belt.

Next, the relation between the surface resistance ρs of the transfer belt 14 and the output voltage $V_c$ of the constant-current d.c. power supply 43 was analyzed. Specifically, on cases where the cleaning current $I_C$ was 5 μA, 10 μA, and 20 μA, the output voltage $V_c$ was measured with the surface resistances ρs varied. The distance $L_1$ from the fur brush 37 to the conductive brush 42 was 12.5 mm. A measurement result is shown in FIG. 17. In FIG. 17, the symbol "x" shows that a cleaning failure occurred, as in FIGS. 15 and 16.

As a result of analyzing the measurement results of FIGS. 15 to 17, it has been found that whether or not a cleaning failure occurs, conversely, whether or not the cleaning device 11 exerts proper cleaning performance depends on the output voltage $V_c$ of the constant-current d.c. power supply 43. More specifically, it has been found from the measurement results of FIGS. 15 to 17 that if the output voltage $V_c$ of the constant-current d.c. power supply 43 is less than 5 kV, there occurs no cleaning failure regardless of the cleaning current $I_C$, the distance $L_1$, and the surface resistance ρs. Therefore, in FIG. 18, the cleaning current $I_C$ and the distance $L_1$ with which the output voltage $V_c$ was 5 kV were plotted for cases where the surface resistance ρs was $1\times10^8$ Ω/□, $1\times10^9$ Ω/□, $1\times10^{10}$ Ω/□, $1\times10^{11}$ Ω/□, and $1\times10^{12}$ Ω/□. In this FIG. 18, for the cases that the surface resistance ρs was $1\times10^{10}$ Ω/□ and $1\times10^{11}$ Ω/□, the measurement results shown in FIGS. 15 and 16 were used. For the cases that the surface resistance ρs was $1\times10^8$ Ω/□, $1\times10^9$ Ω/□, and $1\times10^{12}$ Ω/□, the output voltages $V_c$ with the distances $L_1$ varied were similarly measured for the cases where the cleaning current $I_C$ was 5 μA, 10 μA, and 20 μA to obtain the distances $L_1$ with which the output voltage $V_c$ was 5 kV.

Figure 18:
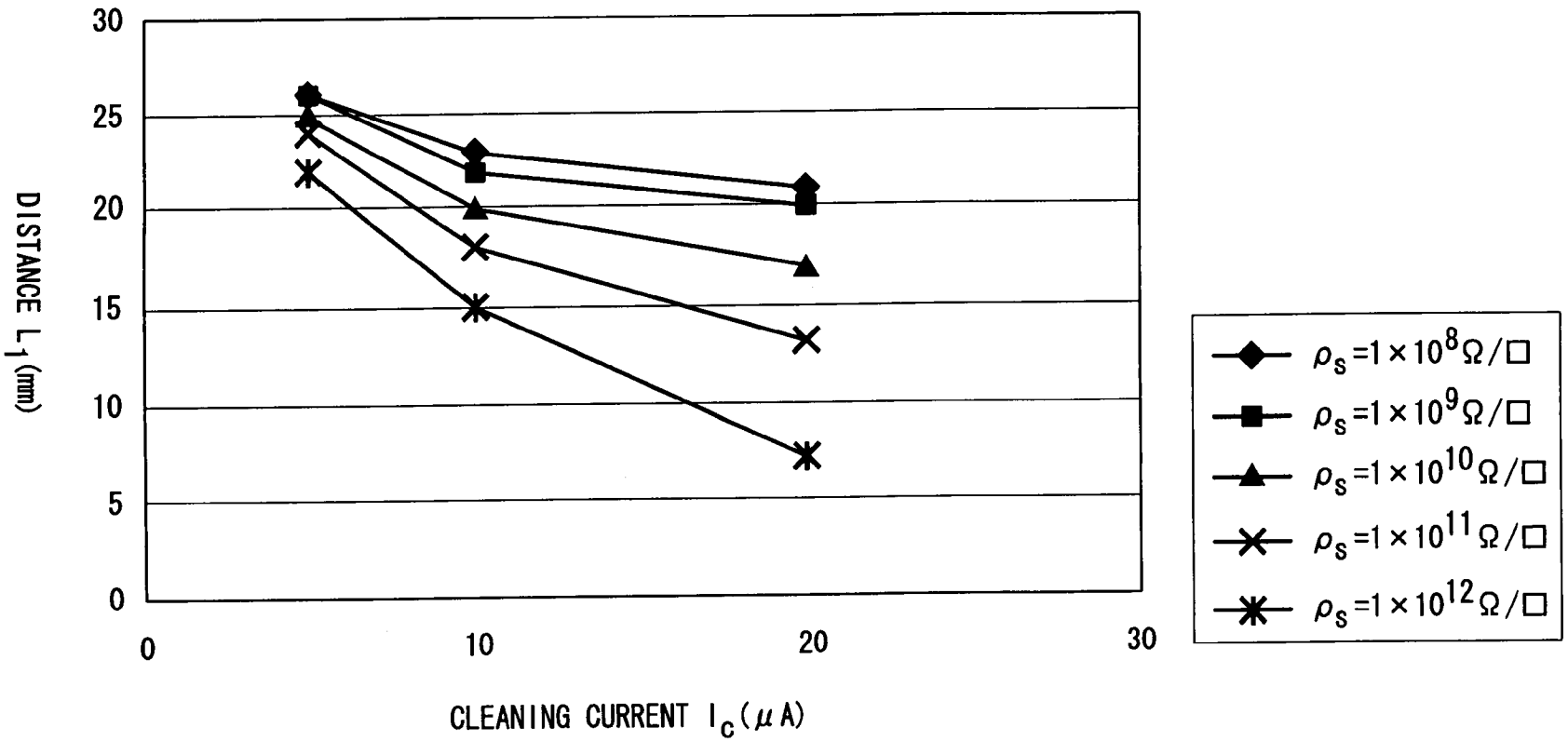
FIG. 18 is a graph view showing a relation between applied current and resistance $L_1$ when the output voltage is 5 kV.

FIG. 18 include five graphs in correspondence to the values of the surface resistance ρs ($1\times10^8$ Ω/□ to $1\times10^{12}$ Ω/□). By determining an approximating curve by logarithm approximation with respect to each of these five graphs, the results of FIG. 18 are given by the following equation (7).

$$L_1=\alpha\cdot\log_e I_C+\beta \tag{7}$$

Figure 19:
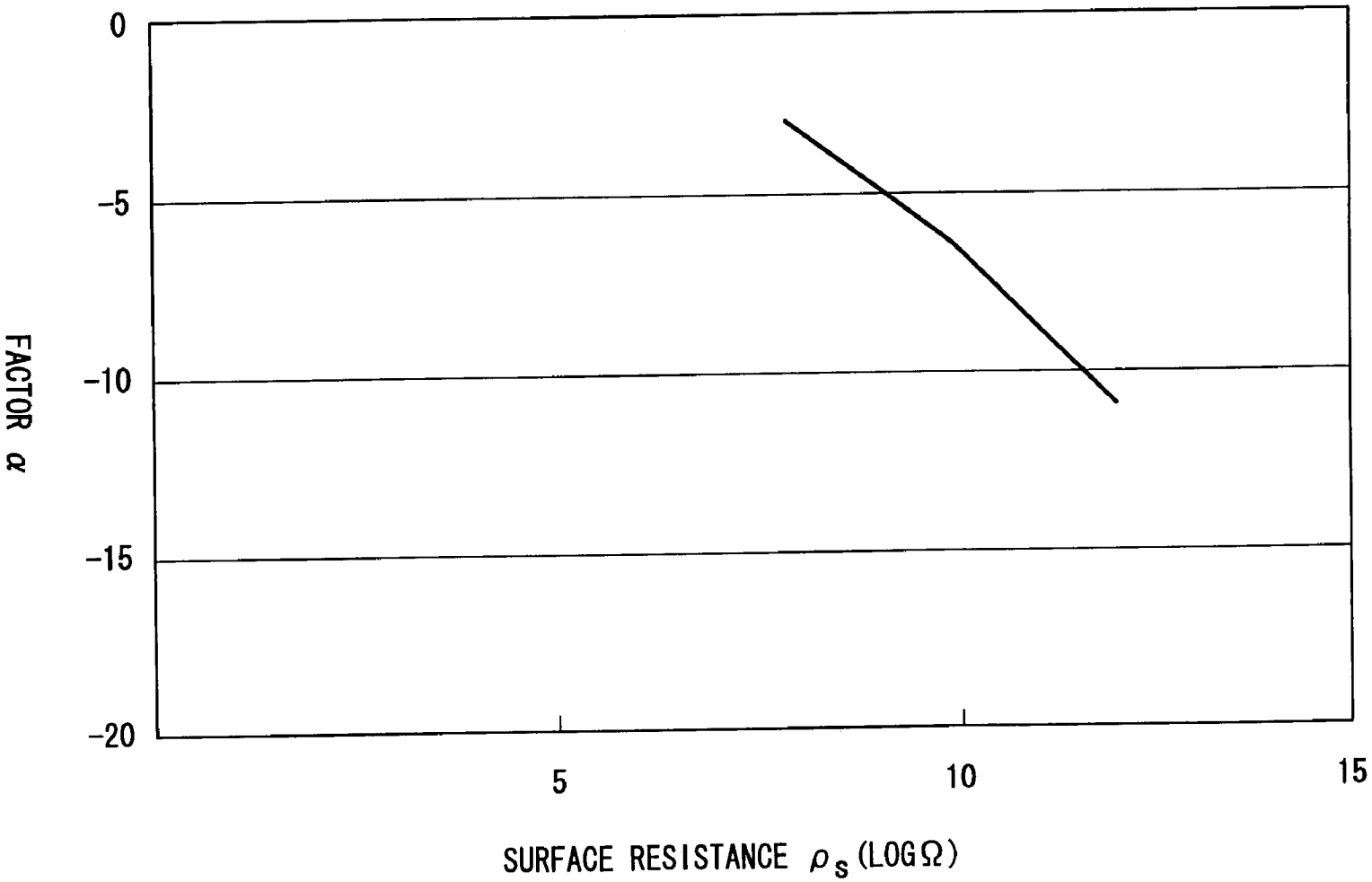
FIG. 19 is a graph view showing a change of a coefficient a with respect to a logarithmic value of the surface resistance of the transfer belt.
Figure 20:
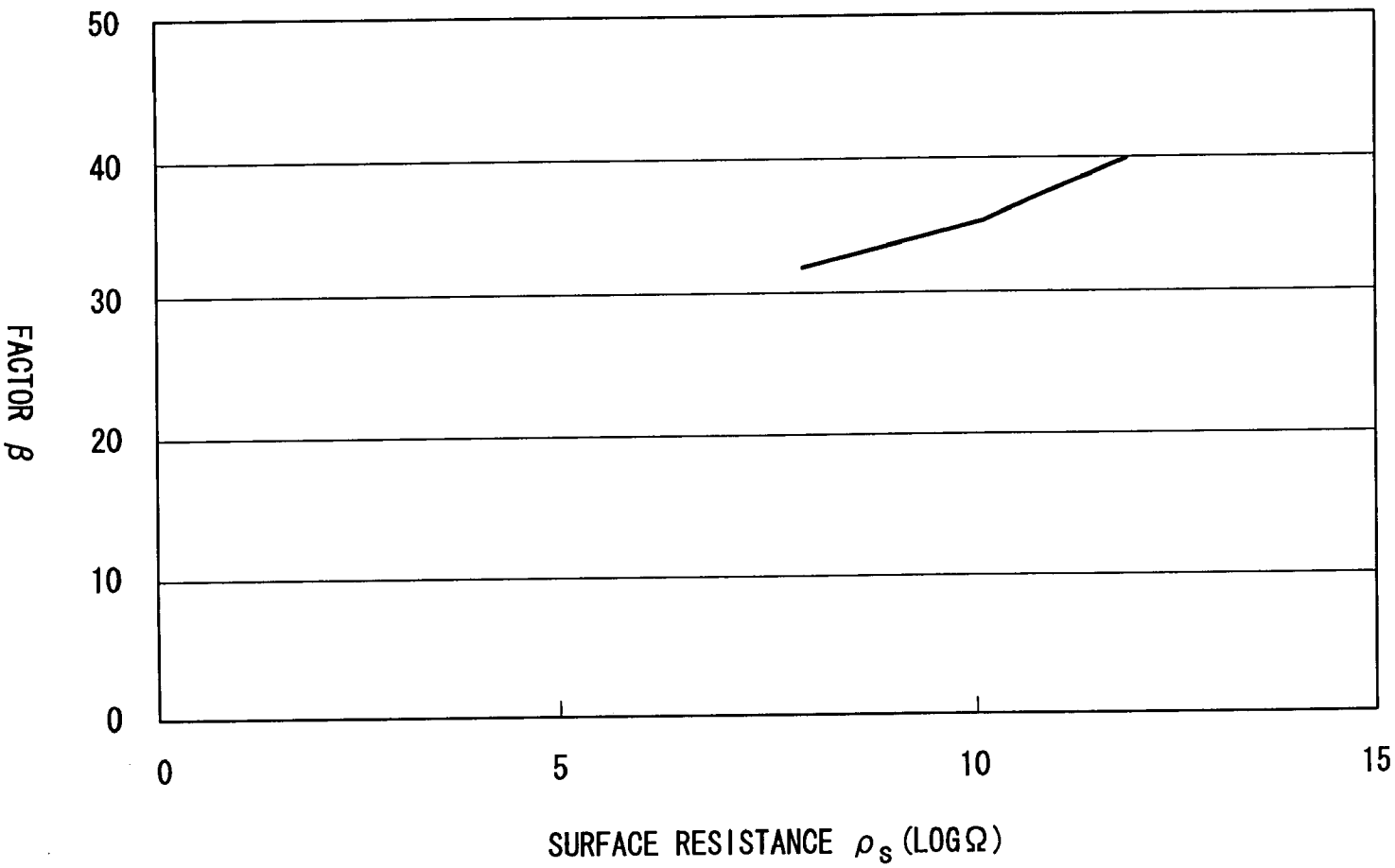
FIG. 20 is a graph view showing a change of a coefficient β with respect to a logarithmic value of the surface resistance of the transfer belt.

The factors α and β are defined by the equations (5) and (6) as described before. Equation (7) was obtained from the measurement results for the range of the surface resistance ρs of $1\times10^8$ Ω/□ to $1\times10^{12}$ Ω/□. Accordingly, substituting ρs=$1\times10^8$, $1\times10^{12}$ into equations (5) and (6), respectively, yields a range of the factor α of −10.2 to −3.01 and a range of the factor β of 31.23 to 39.15. A variation of the factors α and β for the surface resistance ρs is shown in FIGS. 19 and 20.

Equation (7) shows a condition under which the output voltage $V_c$ is 5 kV, in other words, a condition under which a cleaning failure occurs due to that output voltage $V_c$ becomes greater than or equal to the voltage. Consequently, the cleaning device 11 exerts the proper cleaning performance on condition that the distance $L_1$ between the rotary member (fur brush 37 or conductive roller 45) and the conductive member (conductive brush 42, conductive film 47 or fur brush 57) is less than that of the right side of the equation (7).

Figure 21:
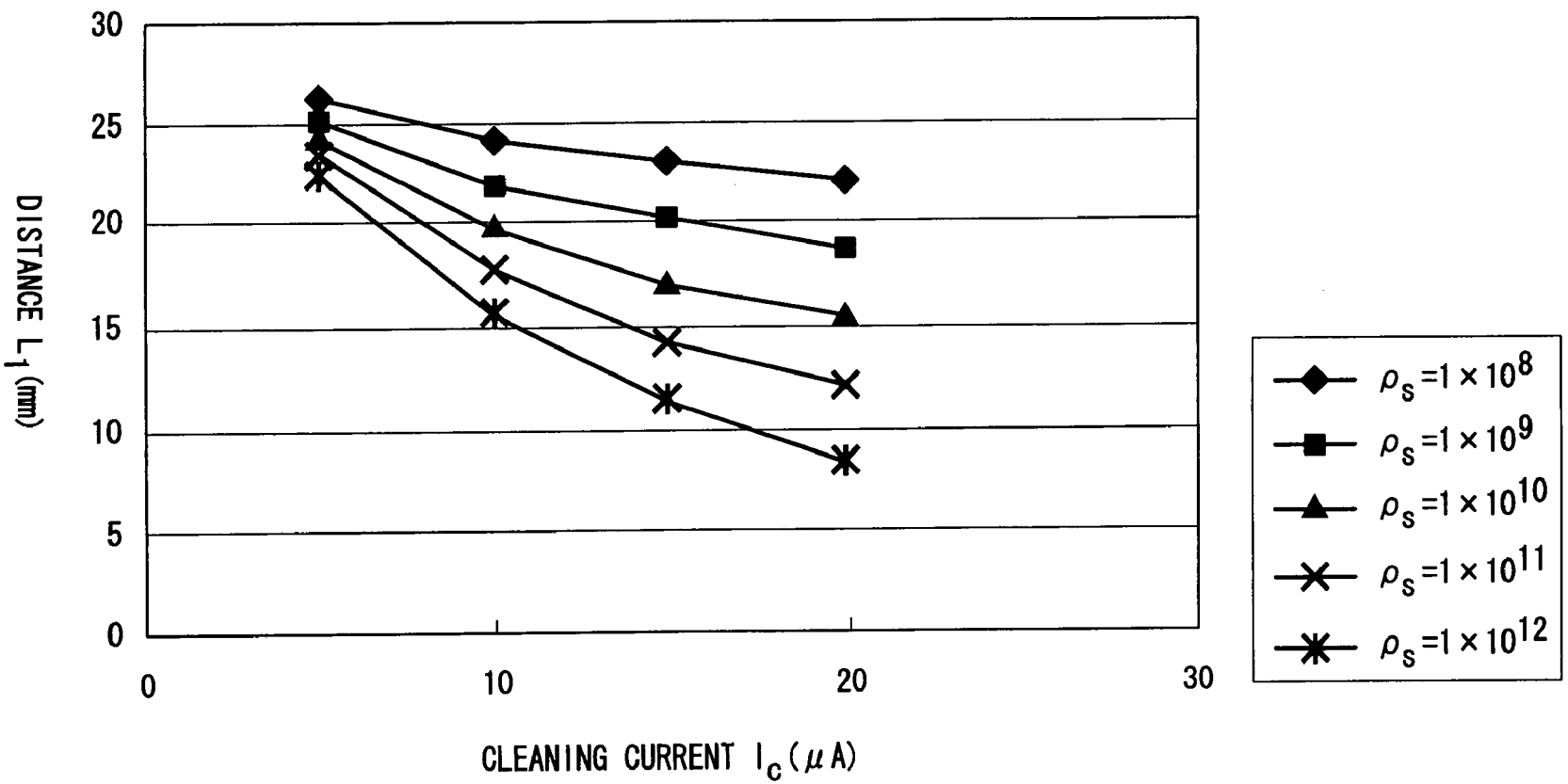
FIG. 21 is a graph view showing a result of substituting various surface resistance values of the various transfer belt and cleaning current values into a conditional expression of the present invention.

FIG. 21 shows results of substituting 5 μA, 10 μA, and 20 μA as the cleaning currents $I_C$ into equation (7) for the cases where the surface resistance ρs was $1\times10^8$ Ω/□, $1\times10^9$ Ω/□, $1\times10^{11}$ Ω/□, $1\times10^{12}$ Ω/□ and $1\times10^{12}$ Ω/□. In a comparison of this FIG. 18 with FIG. 21, it can be conformed that equation (7) adequately approximates the results of FIG. 18.

The right side of equation (4) is then explained. Given a void t (mm) between two conductors and a void breakdown voltage $V_B$ (V), Paschen's law is given by the following equation (8).

$$V_B=6200t+312 \tag{8}$$

Transforming this equation about the void t yields the following equation (9):

$$t=\frac{V_B-312}{6200} \tag{9}$$

Equation (9) shows a minimum void t at which void discharge does not occur between two conductors with respect to a given voltage. Accordingly, if the distance $L_1$ is larger than that of an equation obtained by replacing the void breakdown voltage $V_B$ of the right side of equation (9) with the output voltage $V_c$, then void discharge does not occur between the rotary member (fur brush 37 or conductive roller 45) of the collection section 35 and the conductive member (conductive brush 42, conductive film 47 or fur brush 57) of the charge-eliminating section 36, thus allowing a closed circuit via the transfer belt 14 to be formed therebetween.

(Ninth Embodiment)

Figure 22:
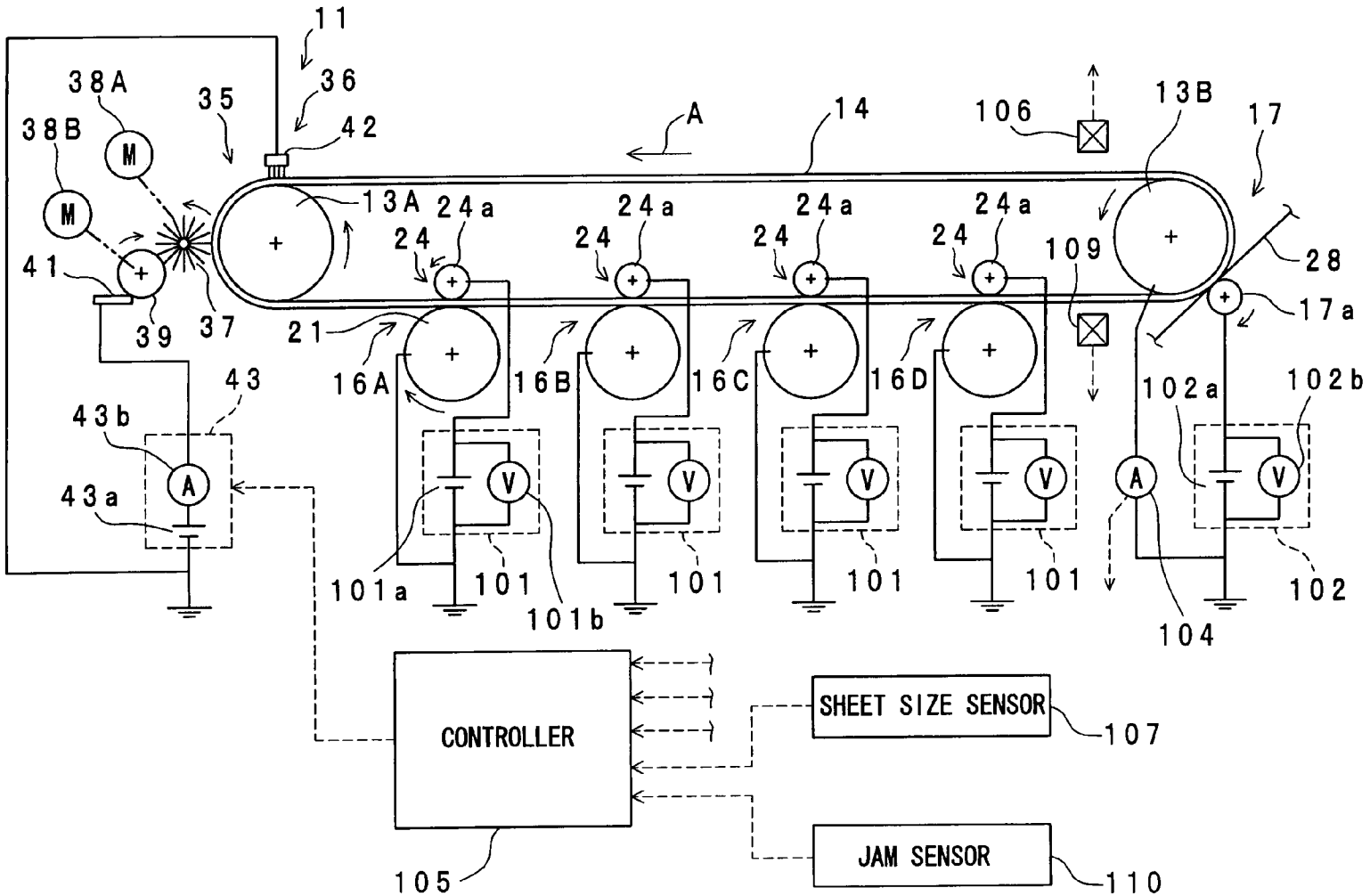
FIG. 22 is a schematic view showing a cleaning device according to a ninth embodiment of the present invention.

FIG. 22 shows an image forming apparatus according to a ninth embodiment of the invention. Whereas FIG. 22 depicts only part of the image forming apparatus of FIG. 1 for sake or explanation, the image forming apparatus of this embodiment has similar construction to that of the first embodiment shown in FIGS. 1 to 3, except that the image forming apparatus of the present embodiment includes elements such as various sensors which will be described later. Therefore, although not shown in FIG. 22, the elements illustrated in FIGS. 1 to 3 are also included in the image forming apparatus of this embodiment. In the following description, reference will be made also to FIGS. 1 to 3 in addition to FIG. 22.

The constant-current d.c. power supply 43 of the cleaning device 11 includes a d.c. power supply 43*a* and a current sensing element 43*b* connected in series to the d.c. power supply 43*a*, and has a function of controlling the output voltage so that the current value of the cleaning current $I_C$ is maintained constant. Further, the constant-current d.c. power supply 43 is enabled to set the cleaning current $I_C$ to various values.

The primary transfer device 24 of each of the image forming units 16A–16D has a conductive roller 24*a* opposed to the photoconductor drum 21 with the transfer belt 14 interposed therebetween. A regulated or constant-voltage power supply 101 is connected to the conductive roller 24*a*. A primary transfer voltage having a charging polarity (positive polarity) reverse to the normal charging polarity of the toner 30 forming a toner image on the surface of the photoconductor drum 21 (negative polarity in this embodiment) is applied to the conductive roller 24*a* by the constant-voltage power supply 101. The constant-voltage power supply 101 includes a d.c. power supply 101*a* and a voltage sensing element 101*b* connected in parallel to this d.c. power supply 101*a*, and has a function of controlling the output current so that the primary transfer voltage is maintained constant. A semiconductive roller may be used instead of the conductive roller 24*a*.

A secondary transfer device 17 is equipped with a conductive roller 17*a* opposed to a stretching roller 14B with the transfer belt 14 interposed therebetween. Similarly to the conductive roller 24*a* of the primary transfer device 24, the conductive roller 17*a* is connected in series to a constant-voltage power supply 102 composed of a d.c. power supply 102*a* and a voltage sensing element 102*b* connected in parallel to this d.c. power supply 102*a*. The d.c. power supply 102*a* has a function of controlling the output current so that the voltage is maintained constant. A semiconductive roller may be used instead of the conductive roller 17*a*. Meanwhile, a stretching roller 13B is grounded, and a secondary transfer current sensor 104 is interposed between the grounding portion and the stretching roller 13B. There is formed a closed circuit from the constant-voltage power supply 102 to the grounding portion via the conductive roller 17*a*, the transfer belt 14, the stretching roller 13B, and the secondary transfer current sensor 104. A secondary transfer voltage having a charging polarity (positive polarity) reverse to the normal charging polarity of the toner 30 forming a toner image on the surface of the transfer belt 14 (negative polarity) is applied to the conductive roller 17*a* by the constant-voltage power supply 102. As a result of this, the toner image on the surface of the transfer belt 14 is transferred to the recording medium 28 that is passing through a nip portion formed between the transfer belt 14 and the conductive roller 24*a*. A current flowing through the closed circuit upon application of the secondary transfer voltage, i.e., a current flowing through the secondary transfer device 17 upon the application of the secondary transfer voltage (secondary transfer current $I_{t2}$) is detected by the secondary transfer current sensor 104. The secondary transfer current sensor 104 outputs a detected value of the secondary transfer current $I_{t2}$ to a controller 105.

An environment sensor 106 is disposed inside the image forming apparatus. This environment sensor 106 senses a humidity H, and outputs a detected value to the controller 105.

A sheet size sensor 107 for detecting the size of the recording medium 28 is disposed on the conveyance path between the sheet feed cassette 27 (see FIG. 1) and the secondary transfer device 17. The sheet size sensor 107 outputs a detected sheet size, i.e., a size of the recording medium 28 to the controller 105.

Between the image forming unit 16D located most downstream of the feed direction of the transfer belt 14 among the image forming units 16A–16D, and the secondary transfer device 17, there is disposed an AIDC (Auto Image Density Control) sensor 109. The image forming units 16A to 16D form toner patches in regions ΔW (see FIG. 3) where the recording medium 28 is not placed on the transfer belt. The AIDC sensor 109 detects the toner concentration at the toner patches, and outputs the detected values to the controller 105.

A jam sensor 110 for detecting blockage or jamming of the recording medium 28 is provided within the image forming apparatus. This jam sensor 110 outputs to the controller 105 signals representing whether or not the jamming occurs.

The controller 105 equipped with such elements as CPU, RAM, and ROM adjusts the cleaning current $I_C$ outputted by the constant-current d.c. power supply 43 of the cleaning device 11 based on inputs from the secondary transfer current sensor 104, the environment sensor 106, the sheet size sensor 107, the AIDC sensor 109, and the jam sensor 110.

Next, the adjustment of the cleaning current $I_C$ executed by the controller 105 is explained with reference to the flowcharts of FIG. 23A and 23B. First, given an image formation of a new job at step S23-1, then the cleaning current $I_C$ is set to an initial value at step S23-2. Then, at step S23-3, a secondary transfer current $I_{t2}$ is detected by the secondary transfer current sensor 104. Specifically, a secondary transfer voltage is applied to the conductive roller 17*a* by the constant-voltage power supply 102 in the state that the recording medium 28 is absent at the nip portion between the conductive roller 17*a* and the transfer belt 14, while a current flowing through the stretching roller 13B is measured by the secondary transfer current sensor 104.

With a small secondary transfer current $I_{t2}$, the toner 30 on the transfer belt 14 is scarcely affected by secondary transfer, having a tendency that the normal charging polarity (negative polarity) is maintained. In this case, since it is less required to invert the charging polarity of the toner 30 from reverse polarity (positive) to normal charging polarity by the cleaning device 11, the cleaning electric field $E_1$ of the collection section 35 and the electric field $E_2$ of the charge-eliminating section 36 can be low in intensity. Accordingly, in the case of the small secondary transfer current $I_{t2}$, the cleaning current $I_C$ can be a small current. On the other hand, with a large secondary transfer current $I_{t2}$, since the toner 30 of the transfer belt 14 is strongly affected by the secondary transfer, there is a tendency that the charging polarity is inverted to a polarity reverse to a normal charging polarity. In this case, it is necessary to uniformize the charging polarity of the toner 30 by setting the strength of the electric field $E_2$ of the discharging section 36 to a sufficiently high, and the electric field $E_1$ of the collection section 35 is preferably high as well. Accordingly, in the case of the large secondary transfer current $I_{t2}$, the cleaning current $I_C$ needs to be large. Thus, if the detected value of the secondary transfer current $I_{t2}$ is equal to or higher than a predetermined threshold value $I_{t2th}$ at step S23-4, the set value of the cleaning current $I_C$ outputted by the constant-current d.c. power supply 43 is increased by a predetermined quantity $\Delta I_{C1}$ at step S23-5.

Next, at step S23-6, a humidity H inside the image forming apparatus is detected by the environment sensor 106. With a high humidity H, since the electrical conductivity of the sheet would increase due to moisture absorption, the transfer efficiency of the secondary transfer device 17 would tend to lower and the quantity of the toner 30 remaining on the transfer belt 14 would tend to increase. Thus, if the detected value of the humidity H is equal to or higher than a predetermined threshold value $H_{th}$ at step S23-7, the set value of the cleaning current $I_C$ is increased by a predetermined quantity $\Delta I_{C2}$ at step S23-8.

At step S23-9, a detected value of the sheet size sensor 107 is read in. With reference to FIG. 3, since the width W3 of the transfer belt 14 is wider than the maximum width W2 of the sheet or recording medium 28, areas ΔW not faced to the sheet are present on both sides of the transfer belt 14. Ideally, toner does not adhere to these zones ΔW, but actually there occurs a phenomenon that the toner thinly adheres also to the zones ΔW (i.e., so-called toner fogging) at the primary transfer device 24 of each of the image forming units 16A–16D. The smaller the sheet size is, the more the zones ΔW where the sheet on the transfer belt 14 is absent increase in area, resulting that the toner quantity tends to increase due to the fogging. Accordingly, in this case, there is a need for enhancing the toner collection efficiency by setting the cleaning electric field $E_1$ of the collection section 35 of the cleaning device 11 to a high strength. Conversely, the larger the sheet size is, the more the area of the zones ΔW decreases, resulting in that the quantity of residual toner due to fogging tends to decrease. In this case, the cleaning electric field $E_1$ of the collection section 35 is allowed to be relatively low in strength. Therefore, when sheet size detected by the sheet size sensor 107 at step S23-10 is equal to or smaller than A4 size, the set value of the cleaning current $I_C$ outputted by the constant-current d.c. power supply 43 is increased by a predetermined quantity $\Delta I_{C3}$ at step S23-11.

At step S23-12, an output of the AIDC sensor 109 is read in. As described before, the AIDC sensor 109 detects a toner concentration D in the toner patches on the transfer belt 14. In the case where the detected toner concentration is high, toner concentration of the toner image on the transfer belt 14 is high so that a large amount of toner tends to remain on the transfer belt 14 even after the secondary transfer. Accordingly, in this case, there is a need for enhancing the toner collection efficiency by setting the cleaning electric field $E_1$ of the collection section 35 of the cleaning device 11 to a high strength. Conversely, in the case where the detected toner concentration is low, toner concentration of the toner image on the transfer belt 14 is low so that a small amount of toner tends to remain on the transfer belt 14 after the secondary transfer. Accordingly, in this case, the cleaning electric field $E_1$ of the collection section 35 can be relatively low in strength. Thus, if the detected value of the toner concentration D is equal to or higher than a predetermined threshold value $D_{th}$ at step S23-13, the set value of the cleaning current $I_C$ outputted by the constant-current d.c. power supply 43 is increased by a predetermined quantity $\Delta I_{C4}$ at step S23-14.

In the event that a jamming has occurred, the image forming apparatus comes to a halt while the toner image that has not been transferred to the recording medium 28 still remains on the transfer belt 14. Therefore, since a large amount of toner has been remaining on the transfer belt 14 at a restart after occurrence of a jamming, i.e., at a first job after the occurrence of a jamming, there is a need for enhancing the toner collection efficiency by setting the cleaning electric field $E_1$ of the collection section 35 of the cleaning device 11 to a high strength. Thus, if the job is a first job after detection of a jamming by the jam sensor 110 at step S23-15, the set value of the cleaning current $I_C$ is increased by a predetermined quantity $\Delta I_{C5}$ at step S23-16. In detail, the cleaning current $I_C$ is increased temporarily only for at least a period that is required for the transfer belt 14 to make one turn after the start of the job.

Figure 23A:
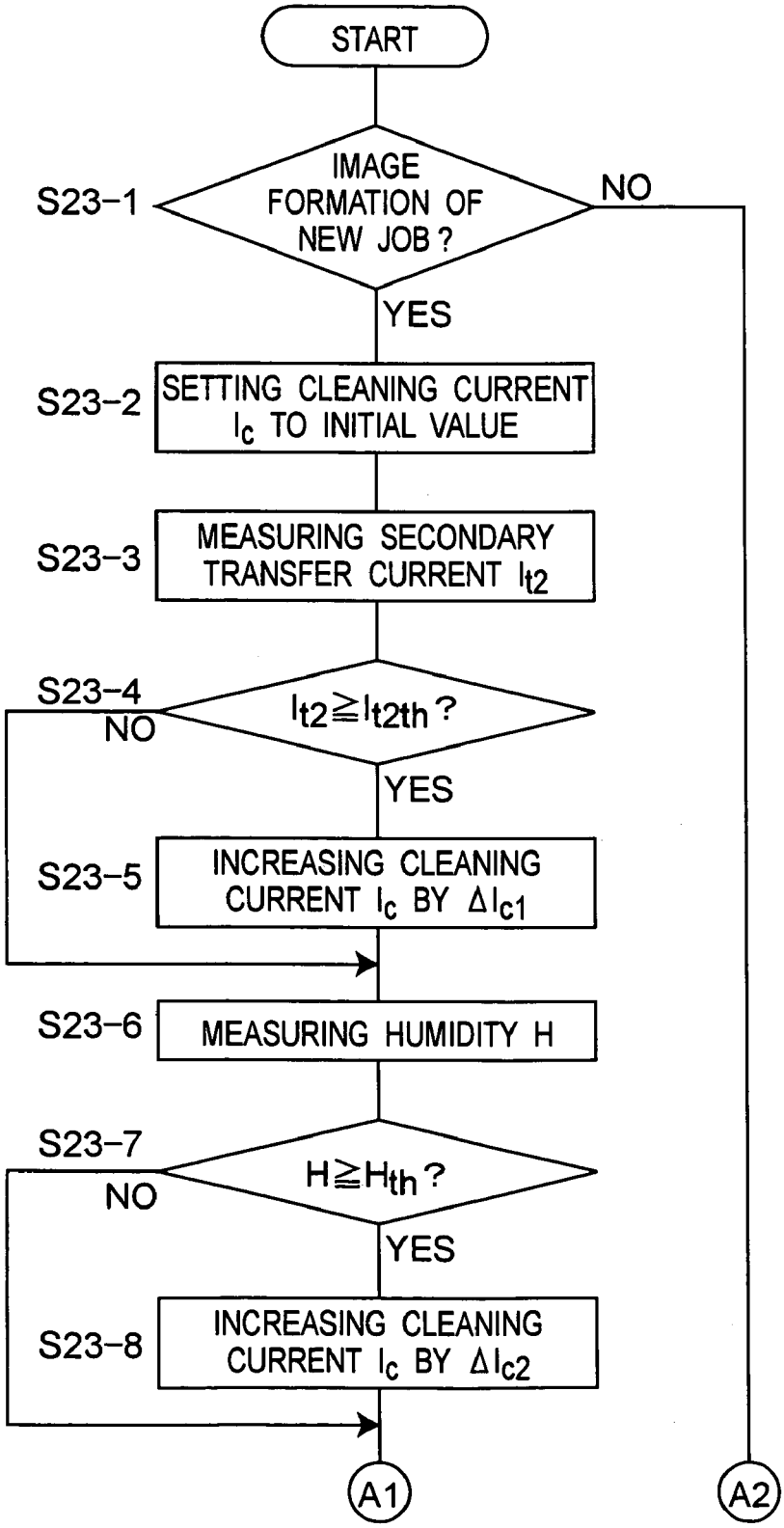
FIG. 23A is a flowchart explaining the operation of the cleaning device according to the ninth embodiment of the present invention.
Figure 23B:
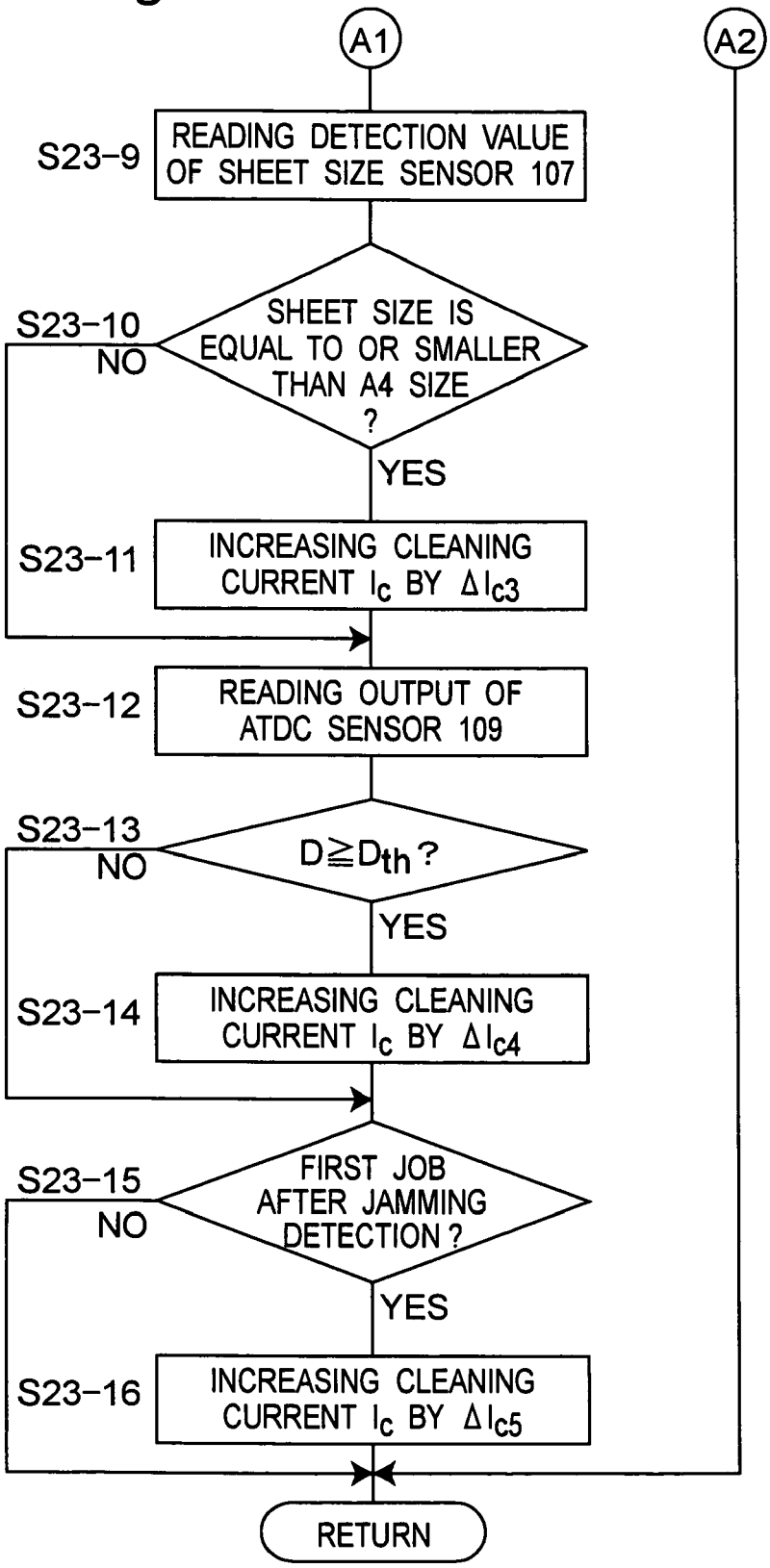
FIG. 23B is a flowchart explaining the operation of the cleaning device according to the ninth embodiment of the present invention.

After the completion of the processing shown in FIGS. 23A and 23B, the actual job is executed. The constant-current d.c. power supply 43 of the cleaning device 11 outputs the cleaning current $I_C$ adjusted according to the charge amount and charge polarity of the toner remaining on the transfer belt 14 as well as on the amount of toner remaining on the transfer belt 14. Therefore, the cleaning device 11 is enabled to exert proper cleaning performance and remove the toner remaining on the transfer belt 14 reliably and efficiently. For instance, the initial value of the cleaning current $I_C$ and its control amounts $\Delta I_{C1}$ to $\Delta I_{C5}$ are set so that the cleaning current $I_C$ is changed within a range from 3 μA to 50 μA.

The controller 105 may execute the control shown in FIGS. 23A and 23B not on the job basis but on the sheet or recording medium 28 basis.

Figure 24A:
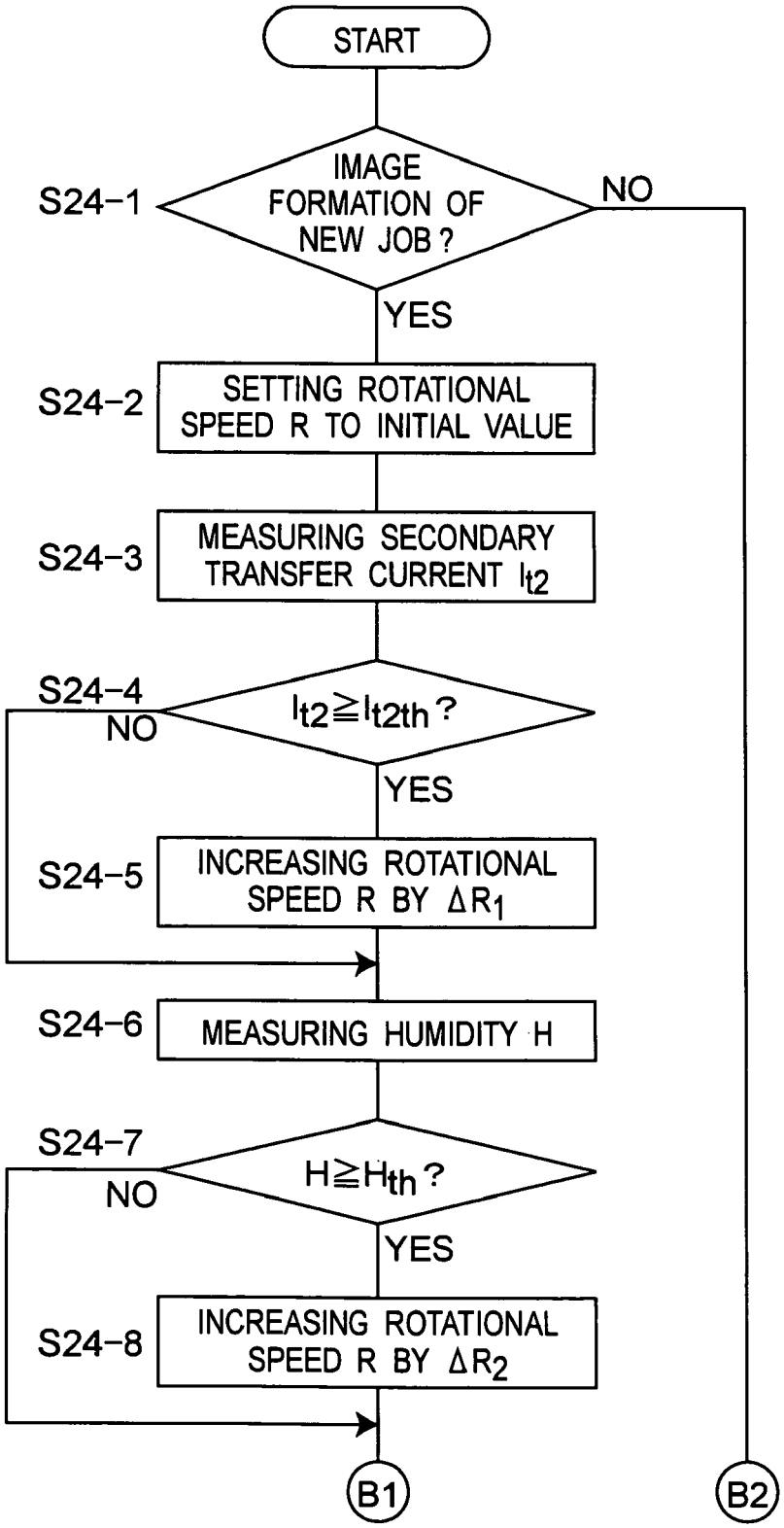
FIG. 24A is a flowchart explaining the operation of a cleaning device of a modified example of the ninth embodiment of the present invention.
Figure 24B:
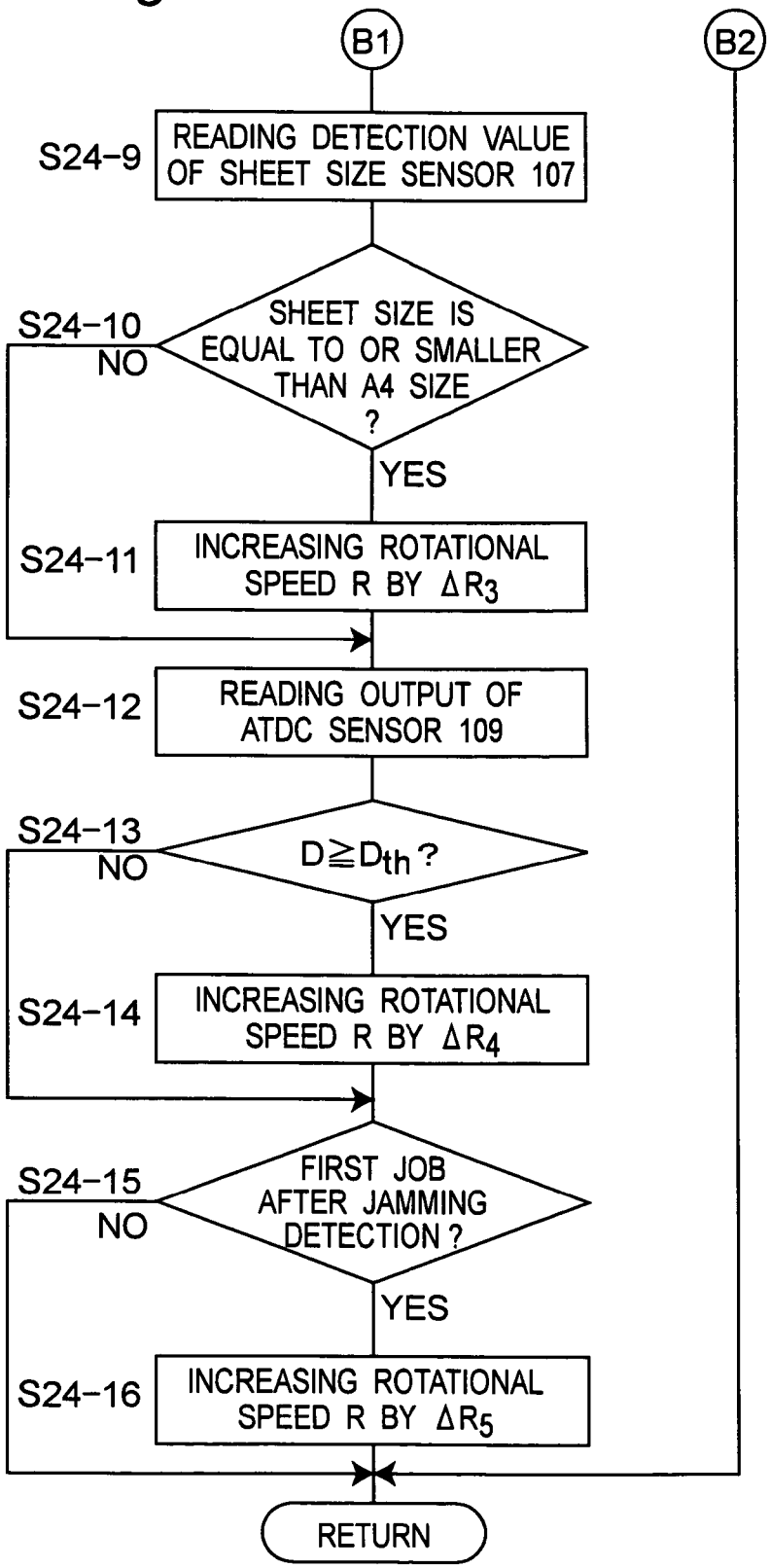
FIG. 24B is a flowchart for explaining the operation of a cleaning device of a modified example of the ninth embodiment of the present invention.

Although the cleaning current $I_C$ is adjusted in the control of FIGS. 23A and 23B, it is also possible to adjust the rotational speed of the fur brush 37 (rotary member) provided in the collection section 35 of the cleaning device 11, more specifically the rotational speed of the motor 38A that drives the rotation of the fur brush 37 as shown in FIGS. 24A and 24B. The faster the rotational speed of the fur brush 37 is, the higher the toner collection efficiency of the cleaning device 11 is. Conversely, the slower the rotational speed of the fur brush 37 is, the lower the toner collection efficiency of the cleaning device 11 is.

Given an image formation of a new job at step S24-1, then the rotational speed R of the motor 38A is set to an initial value at step S24-2. If the secondary transfer current $I_{t2}$ detected by the secondary transfer current sensor 104 at S24-3 is equal to or more than a threshold value $I_{t2th}$ at step S24-4, then the set value of the rotational speed R is increased by a predetermined quantity $\Delta R_1$ at step S24-5. Subsequently, if a humidity H detected by the environment sensor 106 at step S24-6 is equal to or higher than a threshold value $H_{th}$ at step S24-7, then the set value of the rotational speed R is increased by a predetermined quantity $\Delta R_2$ at step S24-8. Further, if a detected value of the sheet size sensor 107 read in at step S24-9 is equal to or smaller than A4 size at step S24-10, then the set value of the rotational speed R is increased by a predetermined quantity $\Delta R_3$ at step S24-11. Further, if a concentration D of the toner patches detected by the AIDC sensor 109 at step S24-12 is equal to or more than a threshold value $D_{th}$ at step S24-13, then the set value of the rotational speed R is increased by a predetermined quantity $\Delta R_4$ at step S24-14. If the job is a first job after detection of a jamming at step S24-15, then the set value of the rotational speed R is increased by a predetermined quantity $\Delta R_5$ for at least a period that is required for the transfer belt 14 to make one turn at step S24-16.

After the completion of the processing shown in FIGS. 23A and 23B, the actual job is executed. The fur brush 37 provided in the collection section 35 of the cleaning device 11 rotates at a rotational speed adjusted according to the charge amount and charge polarity of the toner remaining on the transfer belt 14 as well as on the amount of toner remaining on the transfer belt 14. Therefore, the cleaning device 11 is enabled to exerts proper cleaning performance and remove the toner remaining on the transfer belt 14 reliably and efficiently.

Figure 25:
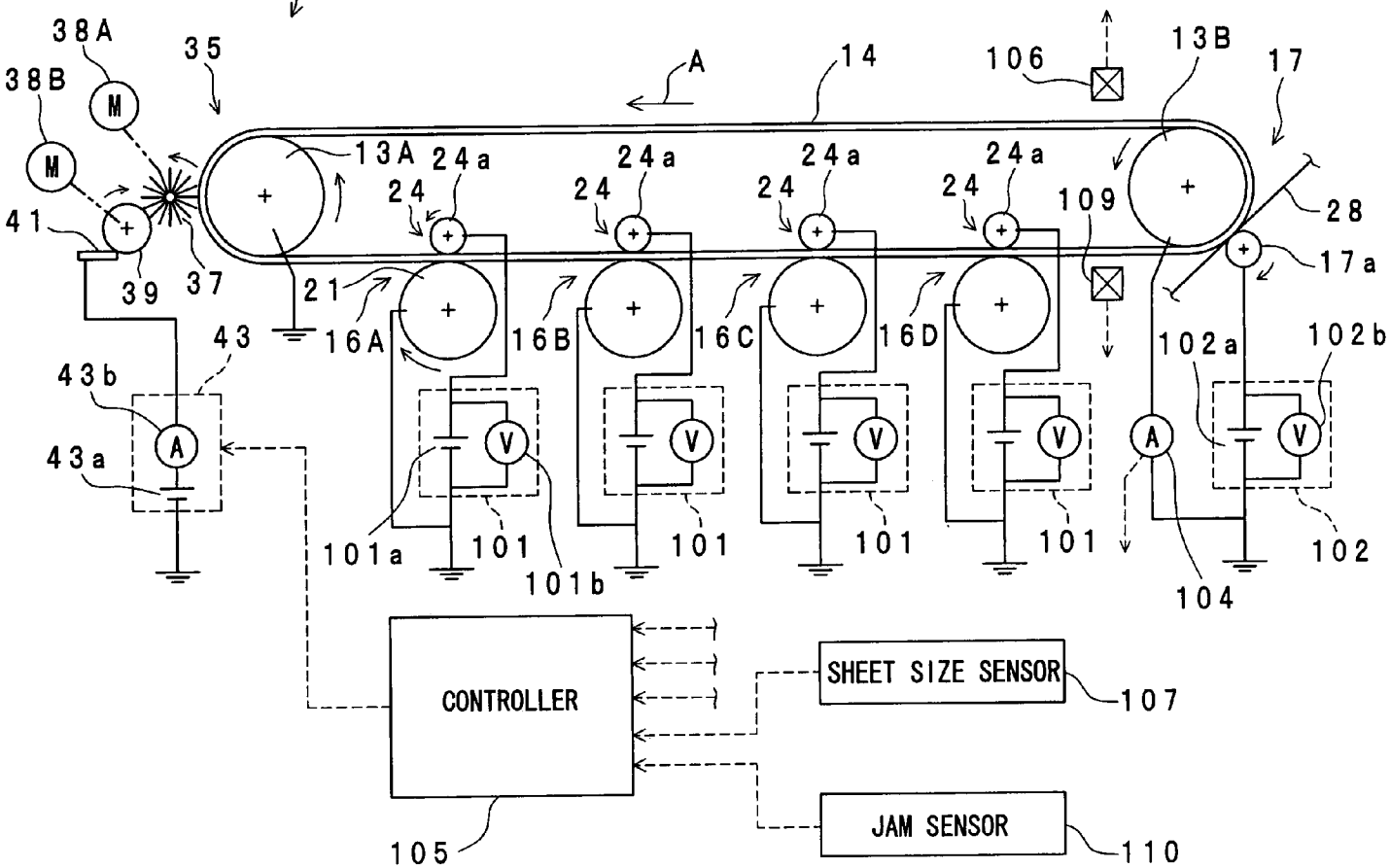
FIG. 25 is a schematic view showing a cleaning device of a modified example of the ninth embodiment of the present invention.

The adjustment of the cleaning current $I_C$ (FIGS. 23A and 23B) and the adjustment of the rotational speed R of the motor 38A (FIGS. 24A and 24B) can be applied in combination. The environment sensor 106 may detect the temperature inside the image forming apparatus in addition to or instead of humidity. In this case, the higher the detected temperature is, the larger the cleaning current $I_C$ is set and the higher the rotational speed R of the motor 38A is set. Conversely, the lower the detected temperature is, the lower the cleaning current $I_C$ is set and the lower the rotational speed R of the motor 38A is set. Further, the cleaning device 11 of the ninth embodiment may be of the construction adopted in the second to seventh embodiments (see FIGS. 7 to 14). Also, the cleaning device 11 of the ninth embodiment may be so constructed that, as shown in FIG. 25, the stretching roller 13A opposed to the collection section 35 with the transfer belt 14 interposed therebetween is grounded without the provision of the discharging section 36. Furthermore, the control of this embodiment can be applied also to the primary transfer device for the collection of the residual toner on the photoconductor (Tenth Embodiment)

Figure 26:
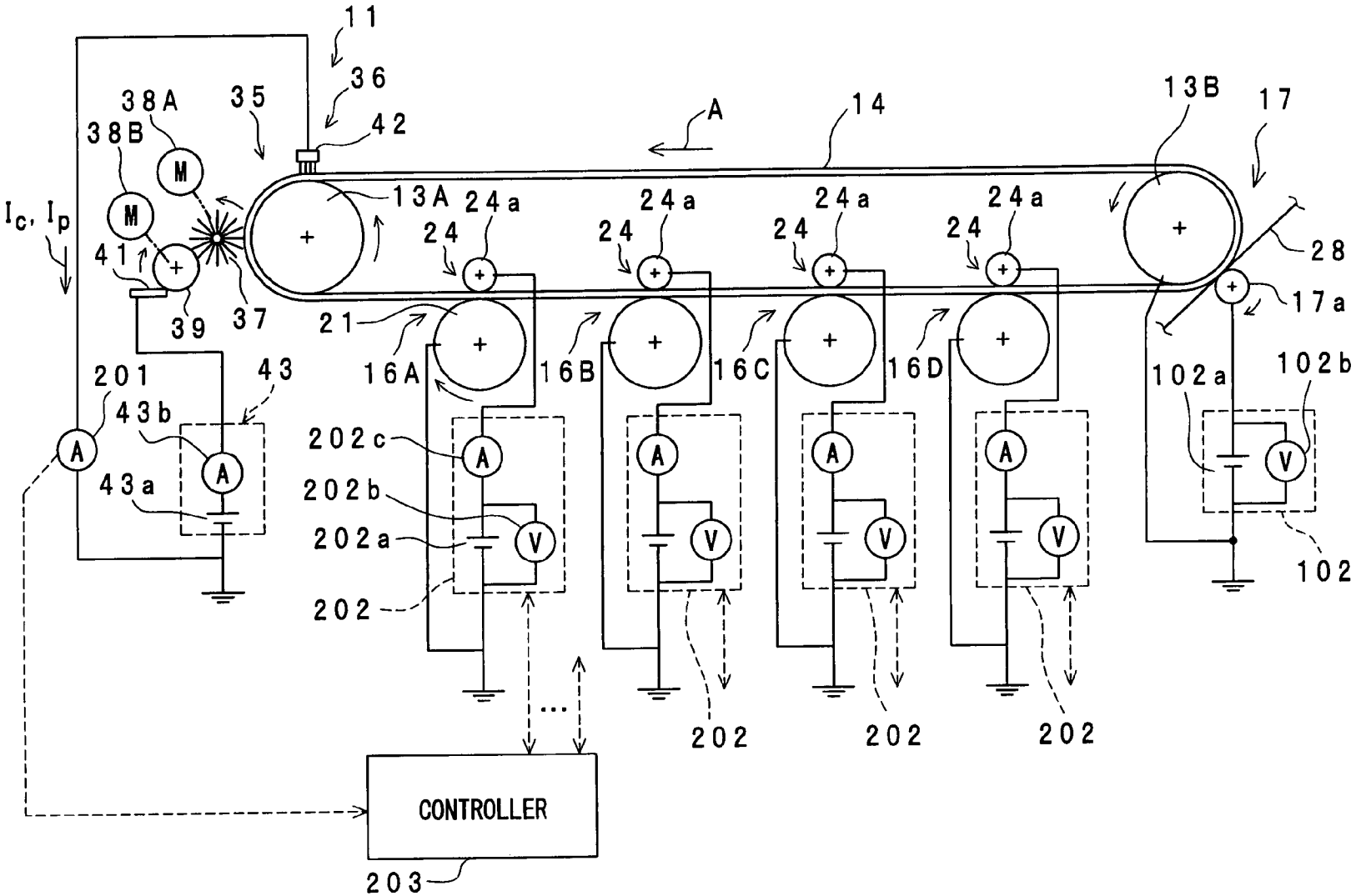
FIG. 26 is a schematic view showing an image forming apparatus according to a tenth embodiment of the present invention.

FIG. 26 shows an image forming apparatus according to a tenth embodiment of the invention. FIG. 26 depicts only part of the image forming apparatus of FIG. 1 for sake of explanation. The image forming apparatus of the tenth embodiment is similar in construction to that of the first embodiment shown in FIGS. 1 to 3, except that the image forming apparatus of the present embodiment includes elements such as various sensors will be described later. Therefore, although not shown in FIG. 26, the elements illustrated in FIGS. 1 to 3 are also included in the image forming apparatus of this embodiment. In the following description, reference will be made also to FIGS. 1 to 3 in addition to FIG. 26.

The constant-current d.c. power supply 43 of the cleaning device 11 includes a d.c. power supply 43*a* and a current sensing element 43*b* connected in series to the d.c. power supply 43*a*, and has a function of controlling the output voltage so that the current value of the cleaning current $I_C$ is maintained constant. A return current sensor 201 is provided between the discharging section 36 and the grounding portion. The return current sensor 201 outputs a detection value of a detected current (return current $I_R$) to a controller 203.

The primary transfer device 24 of each of the image forming units 16A–16D has a conductive roller 24*a* opposed to the photoconductor drum 21 with the transfer belt 14 interposed therebetween. A constant-voltage power supply 202 is connected to the conductive roller 24*a*. A primary transfer voltage $V_{t1}$ having a charging polarity (positive) reverse to the normal charging polarity of the toner 30 forming a toner image on the surface of the photoconductor drum 21 (negative) is applied to the conductive roller 24*a* by the constant-voltage power supply 202. The constant-voltage power supply 202 includes a d.c. power supply 202*a* and a voltage sensing element 202*b* connected in parallel to this d.c. power supply 202*a*, and has a function of controlling the output current so that the primary transfer voltage $V_{t1}$ is maintained constant. Further, in this embodiment, the constant-voltage power supply 202 includes a current sensing element 202*c* connected in series to the d.c. power supply 202*a* so as to be able to control the output current so that the current becomes constant if required. In other words, the constant-voltage power supply 202 can function also as a regulated or constant-current power supply. A semiconductive roller may be used instead of the conductive roller 24*a*.

The controller 203 sets the primary transfer voltage $V_{t1}$ of the primary transfer device 24 of each of the image forming units 16A to 16D. In particular, the controller 203 adjusts the primary transfer voltage $V_{t1}$ of the primary transfer device 24 of the image forming unit 16A, which is placed closest to the cleaning device 11 among the four image forming units 16A to 16D, according to the return current $I_R$.

In the cleaning device 11, there is formed a closed circuit from the constant-current d.c. power supply 43 to the grounding portion via the scraper 41, the collection roller 39, the fur brush 37, the transfer belt 14, the conductive brush 42, and the return current sensor 201. A cleaning current $I_C$ derived from the constant-current d.c. power supply 43 flows in this closed circuit. Therefore, the return current $I_R$ and the cleaning current $I_C$ are normally equal in value to each other. However, when the resistance of the transfer belt 14 has lowered due to endurance or when the humidity inside the image forming apparatus is high, there can occur inflow of a current into the cleaning device 11 from the primary transfer device 24 of the image forming unit 16A that is placed closest to the cleaning device 11 among the four image forming units 16A–16D. Occurrence of this inflow of a current would cause the return current $I_R$ to become larger than the cleaning current $I_C$. More specifically, since the constant-voltage power supply 202 of the primary transfer device 24 controls the current so that the primary transfer voltage $V_{t1}$ is maintained constant, decreased resistance would cause the current to become excessively large, and this excessively large current would flow into the cleaning device 11 via the transfer belt 14. For example, if the return current $I_R$ is 12 μA in spite of that that cleaning current $I_C$ of 10 μA is outputted by the constant-current d.c. power supply 43 of the cleaning device 11, it means that a current of 2 μA flows into the cleaning device 11 from the primary transfer device 24 of the image forming unit 16A. If an excessive primary transfer current that has occurred at the primary transfer device 24 flows through the transfer belt 14, the transfer belt 14 would be damaged, resulting in a shortened life. Therefore, the controller 203 decides the presence or absence of occurrence of the excessive primary transfer current at the primary transfer device 24 of the image forming unit 16A from the value of the return current $I_R$, and adjusts the primary transfer voltage $V_{t1}$ in the primary transfer device 24 of the image forming unit 16A based on the decision.

The process executed by the controller 203 is explained in detail with reference to the flowchart of FIG. 27. First, given an image formation of a new job at step S27-1, then a constant value of current flows simultaneously through the primary transfer devices 24 of the four image forming units 16A–16D at step S27-2. Specifically, the constant-voltage power supply 202 of the primary transfer device 24 of each of the image forming units 16A to 16D is made to function as a constant-current power supply to output the current of constant value. Next, the primary transfer voltages $V_{t1}$ outputted by the primary transfer devices 24 of the image forming units 16A to 16D is respectively measured by the voltage sensing element 101*b* while the constant-value current is passing therethrough at step S27-3. The primary transfer voltages $V_{t1}$ measured at the primary transfer devices 24 are outputted to the controller 203. At step S27-4, a set value for the primary transfer voltage $V_{t1}$ of each of the image forming units 16A to 16D to be used in the actual image formation is determined based on the measured primary transfer voltages $V_{t1}$. Specifically, since set values for the primary transfer voltage $V_{t1}$ corresponding to the primary transfer voltages $V_{t1}$ measured at step S27-3 are stored in the controller 203 in the form of a table, the set values of the primary transfer voltage $V_{t1}$ for actual image formation are uniquely determined to the measured values of the primary transfer voltage $V_{t1}$.

An excessive primary transfer current that occurs at the primary transfer devices 24 of the image forming units 16B to 16D almost fully flows into adjacent other image forming units, thus hardly contributing to increase in the return current $I_R$. Therefore, the primary transfer devices 24 of these image forming units 16B–16D are used for the image formation without adjusting the set values of the primary transfer voltage $V_{t1}$ determined at step S27-4. Meanwhile, with respect to the image forming unit 16A placed closest to the cleaning device 11, the set value of the primary transfer voltage $V_{t1}$ is further adjusted at steps S27-5 to S27-9.

First, at step S27-5, the primary transfer voltage $V_{t1}$ set at step S27-4 is applied to the primary transfer device 24 of the image forming unit 16A. Specifically, a voltage outputted by the constant-voltage power supply 202 of the primary transfer device 24 is taken as the set value of the primary transfer voltage $V_{t1}$. Then, at step S27-6, a return current $I_R$ under the condition that the primary transfer device 24 is outputting the set value of the primary transfer voltage $V_{t1}$ is detected by the return current sensor 201. At step SS27-7, If the detected value of the return current $I_R$ is equal to or higher than a predetermined threshold value $I_{Rt}$, i.e., if it is decided that an excessive primary transfer current generated by the primary transfer device 24 of the image forming unit 16A is flowing into the cleaning device 11, then the set value of the primary transfer voltage $V_{t1}$ determined at step S27-4 is decreased by a predetermined quantity $\Delta V_{t1}$. The process of steps S27-5 to S27-8 is repeated until the detected value of the return current $I_R$ becomes less than threshold value $I_{Rth}$ at step S27-7. At step S27-7, if the detected value of the return current $I_R$ is less than the threshold value $I_{Rth}$, then the primary transfer voltage $V_{t1}$ corresponding to the return current $I_R$ is established as the set value of the primary transfer voltage $V_{t1}$ of the image forming unit 16A at step S27-8.

Figure 27:
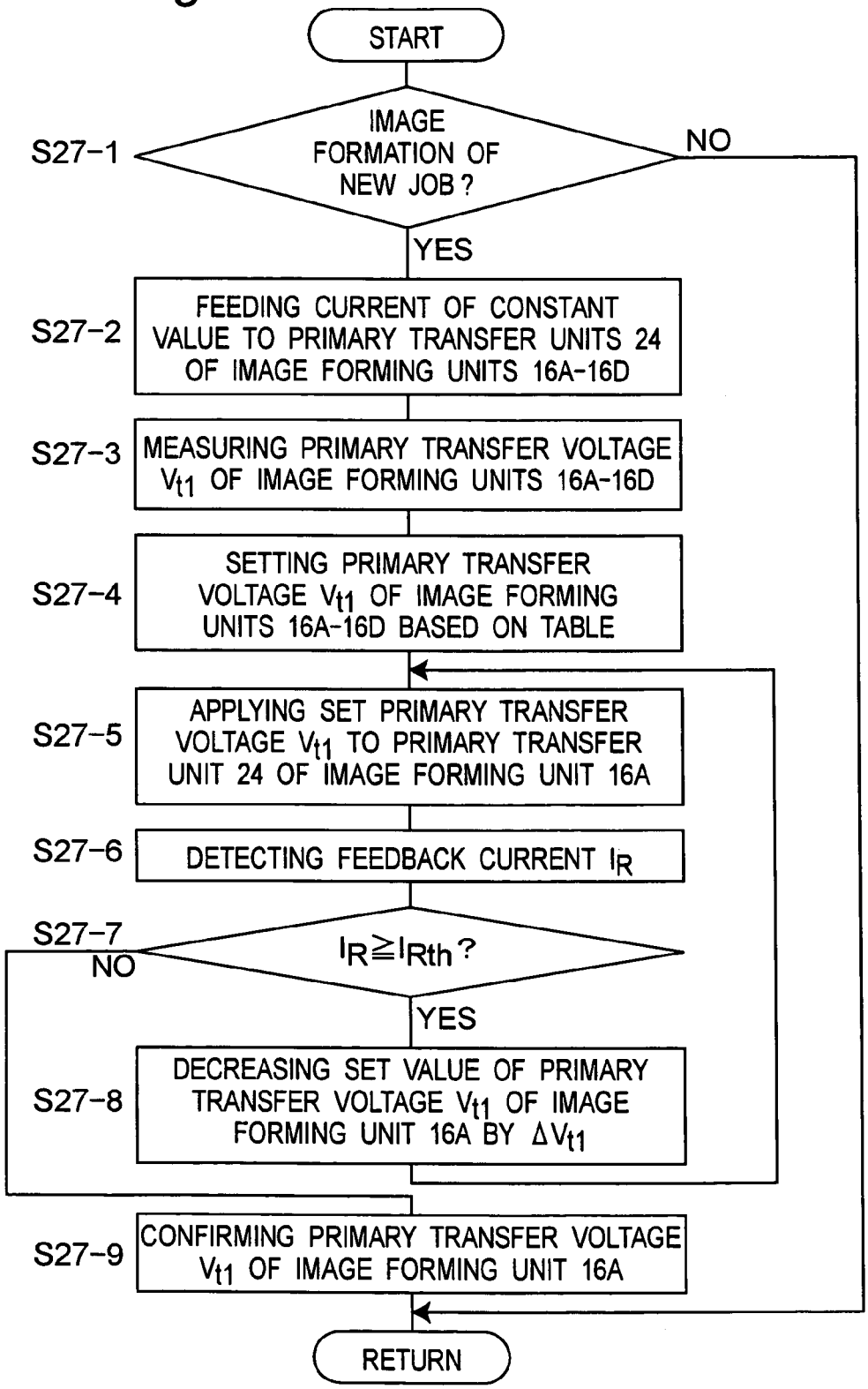
FIG. 27 is a flowchart explaining the operation of the image forming apparatus according to the tenth embodiment of the present invention.

After the completion of the process shown in FIG. 27, the actual job is executed. The primary transfer voltage $V_{t1}$ outputted by the constant-voltage power supply 202 of the image forming unit 16A has been adjusted so that excessive primary transfer current flowing into the cleaning device 11 is not generated. Accordingly, inflow of the excessive current into the transfer belt 14 can be prevented, resulting in that the service life of the transfer belt 14 can be prolonged.

The controller 203 may execute the control shown in FIG. 27 not on the job basis but on the sheet or recording medium 28 basis.

Figure 28:
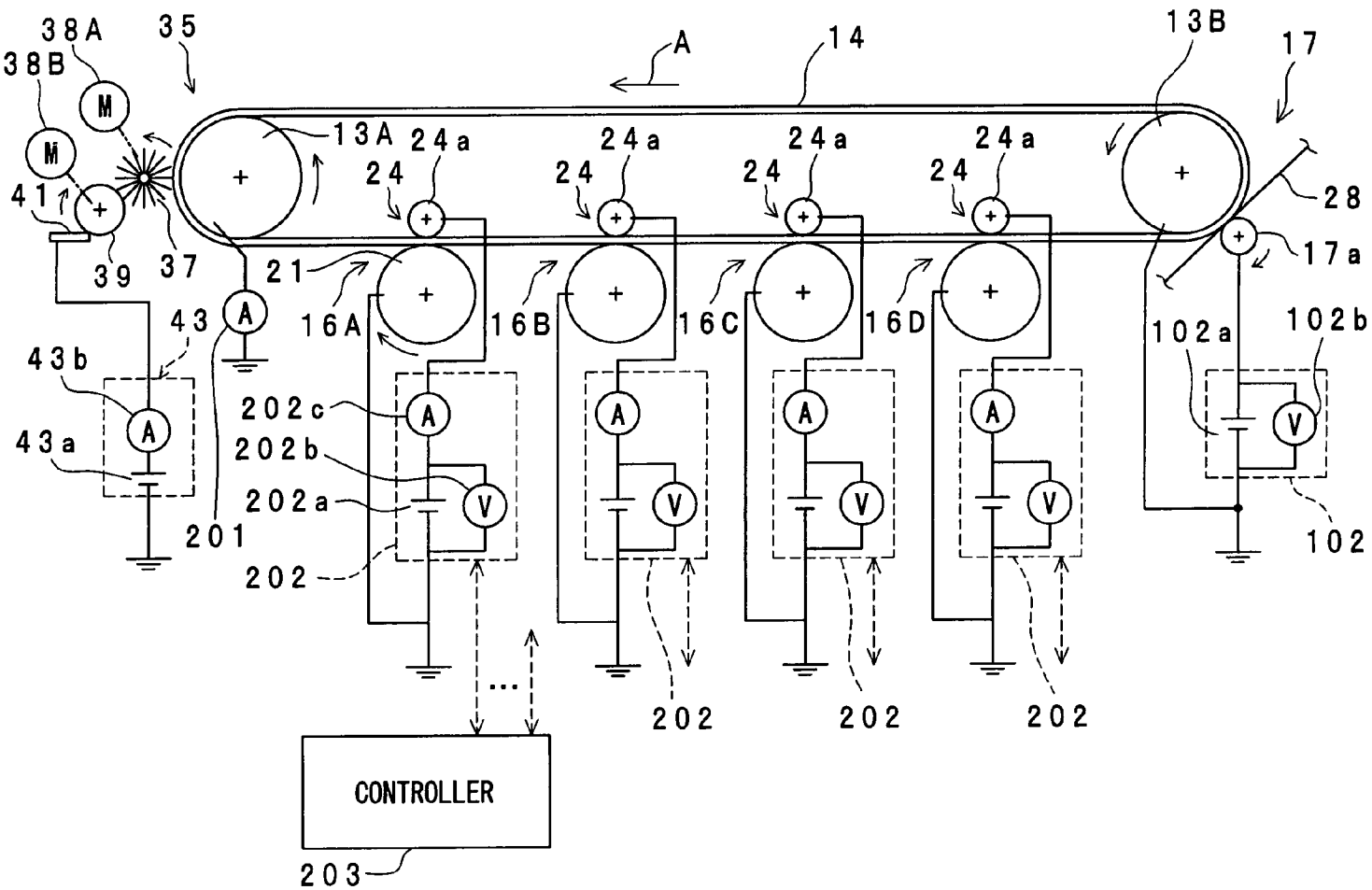
FIG. 28 is a schematic view showing an image forming apparatus of a modified example of the tenth embodiment of the present invention.
Figure 29:
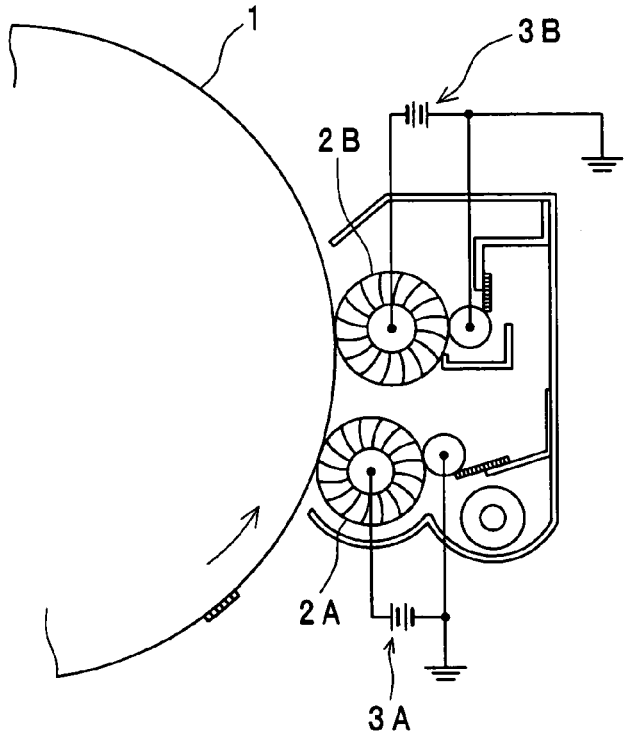
FIG. 29 is a schematic view showing one example of a conventional cleaning device.
Figure 30:
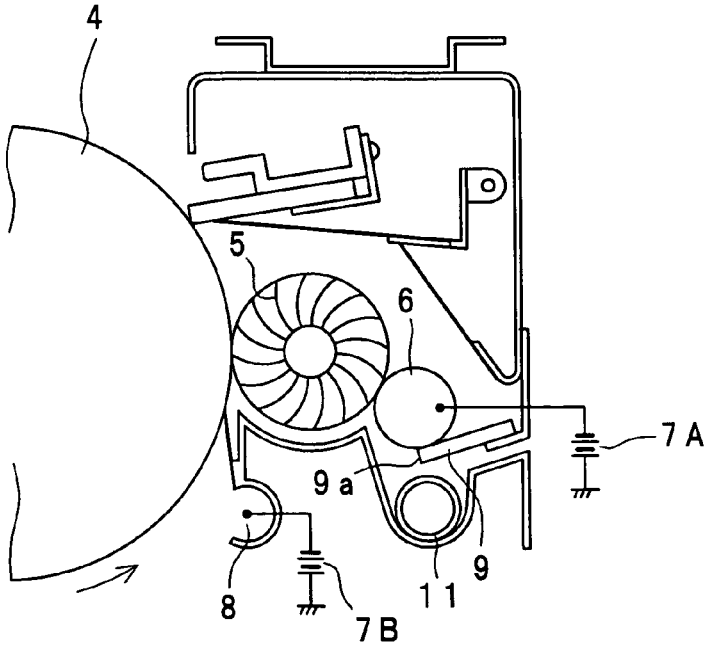
FIG. 30 is a schematic view showing another example of a conventional cleaning device.

The cleaning device 11 of the tenth embodiment may be of the construction adopted in the second to seventh embodiments (see FIGS. 7 to 14). Also, the cleaning device 11 of the tenth embodiment may be so constructed that, as shown in FIG. 28, the stretching roller 13A confronting the collection section 35 with the transfer belt 14 interposed therebetween is grounded without the provision of the charge-eliminating section 36. In this case, the return current sensor 201 is provided between the stretching roller 13A and the grounding portion.

The present invention is not limited to the foregoing embodiments, and may be modified in various ways. For example, the core metal 37*a* (see FIG. 2 and FIGS. 7 to 11) of the fur brush 37 of the collection section 35 or the core metal (see FIG. 6) of the conductive elastic roller 45 may be connected directly to the constant-current d.c. power supply 43. Also, a metallic roller may be used as the rotary member of the collection section 35.

Conductive rubber may be used instead of the conductive brush 42 (see FIGS. 2, 6, 8, and 11), the conductive film 47 (see FIGS. 7 and 10), and the fur brush 57 (see FIG. 9). The conductive brush 42, the conductive film 47, and the fur brush 57 may be grounded via a resistor. Adjusting the resistance value of the resistor allows the present invention to be applied to transfer belts have various resistance values and characteristics.

Further, when the normal charging polarity of the toner is reverse to the foregoing embodiments, i.e. positive, the polarity of the voltage applied from the constant-current power supply to the collection section 35 or the discharging section 36 is reversed. For example, if the normal charging polarity of the toner is positive in the first embodiment, it is appropriate to connect the scraper 41 to the negative terminal of the constant-current d.c. power supply 43.

Further, the present invention may also be applied to the cleaning device of the intermediate transfer drum or the photoconductor of the photoconductor drum or the like.

Furthermore, the present invention may also be applied to cleaning devices for image bearing bodies provided in other image forming apparatuses such as copying machines, facsimile devices and multi-function machines in addition to laser printers.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A cleaning device for collecting toner on a surface of an image bearing body, comprising:

a rotary member having electrical conductivity and being rotatively driven while being in contact with the surface of the image bearing body;

a conductive member which makes contact with the image bearing body on an upstream side of the rotary member in a conveyance direction of the image bearing body; and a single d.c. power supply to which one of the rotary member and the conductive member is connected, the other being grounded, and which generates a d.c. current that flows via the image bearing body between the rotary member and the conductive member, whereby a first electric field in such a direction as to exert a force for adsorbing the toner of a normal charging polarity to the rotary member is generated between the rotary member and the image bearing body while a second electric field in a direction reverse to the first electric field is generated between the conductive member and the image bearing body.

2. A cleaning device as claimed in claim 1, wherein the rotary member is connected to the d.c. power supply and the conductive member is grounded.

3. A cleaning device as claimed in claim 1, wherein the d.c. power supply is a constant-current d.c. power supply.

4. A cleaning device as claimed in claim 1, wherein the direct current $I_c$ (μA) flowing between the rotary member and the conductive member via the image bearing body, an output voltage $V_c$ (V) of the d.c. power supply, and a distance L1 (mm) from a contact position of the rotary member with the image bearing body to a contact position of the conductive member with the image bearing body in the conveyance direction of the image bearing body satisfy the following relation:

$$\frac{V_c - 312}{6200} < L_1 < \alpha \cdot \log_e I_c + \beta,$$

where α and β are factors related to surface resistance of the image bearing body.

5. A cleaning device as claimed in claim 4, wherein the factor a is between or equal to −10.2 and −3.01.

6. A cleaning device as claimed in claim 4, wherein the factor β is between or equal to 31.23 and 39.15.

7. A cleaning device as claimed in claim 1, further comprising a second conductive member which contacts with the image bearing body on an upstream side of the conductive member in the conveyance of the image bearing body and is grounded.

8. A cleaning device as claimed in claim 1, further comprising a third conductive member which contacts with the image bearing body on a downstream side of the rotary member in the conveyance direction of the image bearing body and is connected to the d.c. power supply.

* * * * *